US008602086B2

(12) United States Patent
Sato

(10) Patent No.: US 8,602,086 B2
(45) Date of Patent: Dec. 10, 2013

(54) APPARATUS FOR PRODUCING AMORPHOUS ALLOY FOIL STRIP AND METHOD FOR PRODUCING AMORPHOUS ALLOY FOIL STRIP

(71) Applicant: Nippon Steel & Sumitomo Metal Corporation, Tokyo (JP)

(72) Inventor: Takashi Sato, Yokohama (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/651,530

(22) Filed: Oct. 15, 2012

(65) Prior Publication Data

US 2013/0037233 A1 Feb. 14, 2013

Related U.S. Application Data

(62) Division of application No. 12/919,043, filed as application No. PCT/JP2009/053067 on Feb. 20, 2009, now Pat. No. 8,327,917.

(30) Foreign Application Priority Data

Feb. 25, 2008 (JP) ..... 2008-042696
Oct. 22, 2008 (JP) ..... 2008-272421
Oct. 22, 2008 (JP) ..... 2008-272422

(51) Int. Cl.
*B22D 11/06* (2006.01)
*B22D 27/04* (2006.01)

(52) U.S. Cl.
USPC ..... 164/480; 164/136; 164/337; 164/423; 164/428; 164/463

(58) Field of Classification Search
USPC ..... 164/137, 337, 423, 463, 480, 136, 428
See application file for complete search history.

(56) References Cited

U.S. PATENT DOCUMENTS 3,823,762 A * 7/1974 Wondris ..... 164/428
4,428,416 A 1/1984 Shimanuki et al.
4,546,815 A 10/1985 Liebermann et al.

(Continued)

FOREIGN PATENT DOCUMENTS

JP 59-064144 A 4/1984
JP 60-108144 A 6/1985

(Continued)

OTHER PUBLICATIONS

International Search Report for PCT/JP2009/053067 dated Apr. 28, 2009.

(Continued)

*Primary Examiner* — Devang R Patel
(74) *Attorney, Agent, or Firm* — Pearne & Gordon LLP

(57) ABSTRACT

A method for producing an amorphous alloy foil strip having a large sheet thickness in an industrial scale includes: a pair of cooling rolls; a driving unit configured to rotate the pair of cooling rolls; and a crucible configured to supply a molten alloy sequentially to an outer circumferential surface of the pair of cooling rolls. The crucible is movable along a moving unit. A molten alloy is supplied alternately to the pair of cooling rolls while rotating and water-cooling the pair of cooling rolls.

8 Claims, 18 Drawing Sheets

(56) References Cited

U.S. PATENT DOCUMENTS

| | | | | |
|---|---|---|---|---|
| 4,600,048 | A | 7/1986 | Sato et al. | |
| 4,650,618 | A | 3/1987 | Heinemann et al. | |
| 4,676,298 | A | 6/1987 | Liebermann | |
| 5,301,742 | A * | 4/1994 | Sato et al. | 164/463 |
| 6,755,234 | B2 | 6/2004 | Blejde et al. | |

FOREIGN PATENT DOCUMENTS

| | | | |
|---|---|---|---|
| JP | 61-199554 | A | 9/1986 |
| JP | 61-59817 | A | 12/1986 |
| JP | 64-005945 | A | 1/1989 |
| JP | 06-086847 | A | 3/1994 |
| JP | 07-310149 | A | 11/1995 |
| JP | 10-085910 | A | 4/1998 |
| JP | 2002-283010 | A | 10/2002 |
| JP | 2009-195967 | A | 9/2009 |

OTHER PUBLICATIONS

Chinese Office action for 200980106060.9 dated Jul. 4, 2012.
Taiwanese Office action for 98105756 dated Jul. 20, 2012.
Japanese Office action for 2008-272422 dated Apr. 25, 2013.
Chinese Office action for 200980106060.9 dated Apr. 2, 2013.

* cited by examiner

APPARATUS FOR PRODUCING AMORPHOUS ALLOY FOIL STRIP AND METHOD FOR PRODUCING AMORPHOUS ALLOY FOIL STRIP

TECHNICAL FIELD

The invention relates to an apparatus for producing an amorphous alloy foil strip and a method for producing an amorphous alloy foil strip, and more specifically, to an apparatus for producing an amorphous alloy foil strip provided with cooling rolls and a method for producing an amorphous alloy foil strip.

BACKGROUND ART

Use of an iron-base amorphous alloy having less power loss as an iron core of a transformer or a motor has heretofore been studied and has been put into practice in some transformers. However, the amorphous alloy has not been practically used in motors and is used only for wound iron cores even in transformers. This is because the sheet thicknesses of amorphous alloy foil strips produced in an industrial scale are as extremely thin as 25 μm or below. If thick foil strips are produced industrially, the amorphous alloy can be also used in motors and in stacked iron-core transformers. An increase in the thickness of foil strips improves operation efficiency of iron-core production processes and also enhances a space factor. Moreover, mechanical strength of an iron core is significantly enhanced by improving rigidity of the foil strips. In other words, the amorphous alloy can be used for a motor provided with an iron core formed by stacking the foil strips or for a stacked iron core.

The most common method for producing an amorphous alloy is a roll liquid quenching method including quenching and solidifying a molten alloy into a foil strip shape by bringing the molten alloy into contact with an outer circumferential surface of a roll, made of metal or an alloy having high thermal conductivity, while rapidly rotating the roll. However, there is a stringent restriction of the sheet thickness of the amorphous alloy foil strip that can be produced by the roll liquid quenching method and it has therefore not been possible to produce a sufficiently thick foil strip.

To address this issue, the inventors of the invention have developed a multiple-slit nozzle method using multiple slits arranged in a circumferential direction of a roll, and have disclosed the method in Patent Document 1. According to this multiple-slit nozzle method, a molten alloy ejected from the slits forms multiple puddles in a small space between the nozzle and the roll, the number of puddles corresponding to the number of the slits. A first puddle, counted from an upstream, around a contact surface thereof with the roll is cooled down on an outer circumferential surface of the roll, whereby a supercooled fluid layer with increased viscosity is drawn by the roll and a puddle on a downstream side is superimposed thereon. The temperature of the fluid layer drawn from the upstream puddle is lowered before the fluid layer meets the downstream puddle. Accordingly, the downstream puddle is cooled down by this fluid layer and a portion with increased viscosity is drawn out. A thick foil strip is formed by repeating this operation. As the fluid layers are superimposed on one another in a liquid state, interfaces thereof are mixed together so that an integrated amorphous alloy foil strip without interlayer boundaries can be obtained.

However, even the multiple-slit nozzle method has the following problem. Specifically, the roll liquid quenching method includes a method using a non-water-cooled roll and a method using a water-cooled roll. The non-water-cooled roll cools the molten alloy down by a heat capacity of the roll itself. In the case of using the non-water-cooled roll, it is possible to cool the molten alloy down efficiently and to produce a certain amount of thick amorphous alloy foil strip at an initial producing state when the roll temperature is low. However, the non-water-cooled roll reduces cooling efficiency when the roll temperature is increased and therefore cannot be used for a long period of time. Accordingly, this is not suitable to produce the amorphous alloy foil strips industrially.

Due to this reason, it is preferable to use the water-cooled roll from an industrial perspective. As a water cooling mechanism is embedded in the water-cooled roll, it is possible to radiate the heat by way of cooling water even when the roll itself has a small heat capacity. However, the thick amorphous alloy having a sheet thickness exceeding 25 μm has been difficult to mass-produce in an industrial scale even by using the water-cooled roll.

[Patent Document 1] JP S60-108144 A
[Patent Document 2] JP H6-86847 U
[Patent Document 3] JP S61-059817 B

DISCLOSURE OF THE INVENTION

Problems to be Resolved by the Invention

The purpose of the invention is to provide an apparatus for producing an amorphous alloy foil strip and a method for producing an amorphous alloy foil strip, which are capable of producing an amorphous alloy foil strip having a large sheet thickness in an industrial scale.

Means for Solving the Problems

According to an aspect of the invention, there is provided an apparatus for producing an amorphous alloy foil strip, including: a first cooling roll; a second cooling roll; a driving unit configured to rotate the first and second cooling rolls; and a supply unit configured to supply a molten alloy sequentially to an outer circumferential surface of the first cooling roll and an outer circumferential surface of the second cooling roll.

According to another aspect of the invention, there is provided an apparatus for producing an amorphous alloy foil strip, including: a cooling roll; a driving unit configured to rotate the cooling roll; and a supply unit configured to supply a molten alloy to an outer circumferential surface of the cooling roll, the cooling roll including: first and second cooling zones surrounding an outer circumferential portion of the cooling roll and being separated from each other in an axial direction of the cooling roll; and a heat insulating zone disposed between the first cooling zone and the second cooling zone and made of a material having lower thermal conductivity than a material used for forming the first and second cooling zones, the supply unit supplying the molten alloy alternately to the first and second cooling zones.

According to yet another aspect of the invention, there is provided a method for producing an amorphous alloy foil strip, including: supplying a molten alloy to an outer circumferential surface of a first cooling roll while rotating the first cooling roll; and resuming the supply of the molten alloy to an outer circumferential surface of a rotating second cooling roll, after moving a molten alloy supply device with the supply of the molten alloy suspended, the supplying the molten alloy and the resuming the supply of the molten alloy after moving a molten alloy supply device with the supply of the molten alloy suspended being alternately performed.

According to yet another aspect of the invention, there is provided a method for producing an amorphous alloy foil strip, including: a first process of supplying a molten alloy to a first cooling zone while rotating a cooling roll, the first cooling zone being provided surrounding an outer circumferential portion of the cooling roll; and a second process of supplying the molten alloy to a second cooling zone while rotating the cooling roll, the second cooling zone being provided surrounding the outer circumferential portion of the cooling roll and located away from the first cooling zone in an axial direction of the cooling roll, the first process and the second process being alternately executed.

According to yet another aspect of the invention, there is provided a method for producing an amorphous alloy foil strip, including: a first process of supplying a molten alloy to a first cooling zone while rotating a cooling roll, the first cooling zone being provided surrounding an outer circumferential portion of the cooling roll; and a second process of supplying the molten alloy to a second cooling zone while rotating the cooling roll, the second cooling zone being provided surrounding the outer circumferential portion of the cooling roll and located away from the first cooling zone in an axial direction of the cooling roll with a heat insulating zone interposed between the first cooling zone and the second cooling zone, the heat insulating zone being made of a material having lower thermal conductivity than a material used for forming the first cooling zone, the second cooling zone being made of a material having higher thermal conductivity than the material used for forming the heat insulating zone, the first process and the second process being alternately executed.

According to yet another aspect of the invention, there is provided a method for producing an amorphous alloy foil strip, including: a first process of supplying a molten alloy to a first cooling zone while rotating a cooling roll, the first cooling zone forming part of an outer circumferential portion of the cooling roll and extending along a circumferential direction of the cooling roll; and a second process of supplying the molten alloy to a second cooling zone while rotating the cooling roll, the second cooling zone being separated from the first cooling zone in an axial direction of the cooling roll with a forbidden zone interposed between the first cooling zone and the second cooling zone, and extending along the circumferential direction of the cooling roll, the first process and the second process being alternately executed.

Effects of the Invention

According to the invention, an apparatus for producing an amorphous alloy foil strip and a method for producing an amorphous alloy foil strip, which are capable of producing an amorphous alloy foil strip having a large sheet thickness in an industrial scale, can be realized.

BRIEF DESCRIPTION OF DRAWINGS

FIGS. 12A and 12B are cross-sectional views illustrating a cooling roll in a variation 1 of the second embodiment, in which FIG. 12A shows a branch pipe including a valve and FIG. 12B shows a roll including a fin.

EXPLANATION OF REFERENCE

Figure 1:
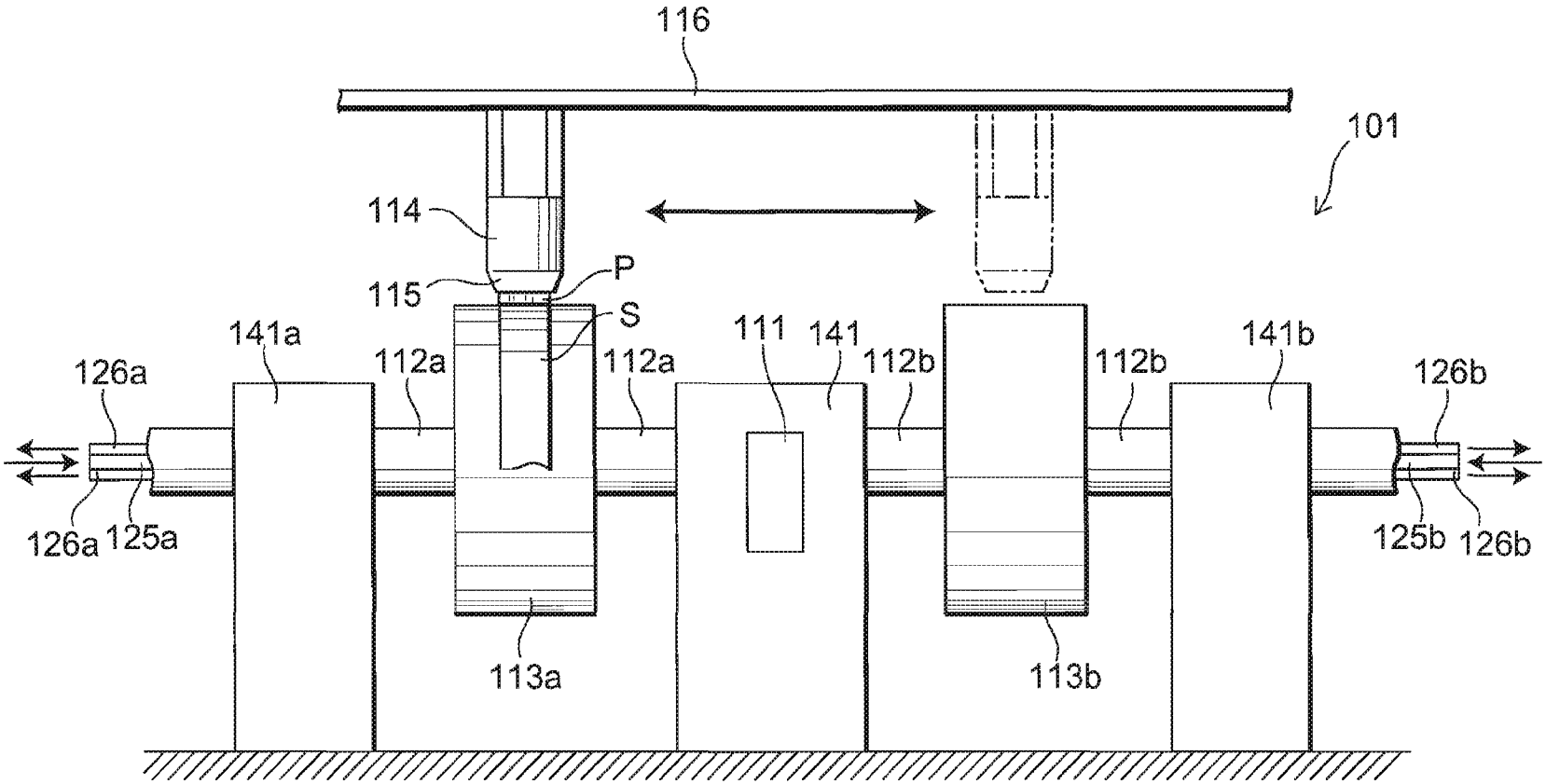
FIG. 1 is a front view illustrating a production apparatus for an amorphous alloy foil strip according to a first embodiment of the invention.

101, 102, 103, 201, 301 production apparatus
111, 211, 311 driving unit
112*a*, 112*b*, 212*a*, 212*b*, 312*a*, 312*b* rotating shaft member
113*a*, 113*b*, 213, 313 cooling roll
114, 214, 314 crucible
115, 215, 315 nozzle
116, 216, 316 moving unit
117*a*, 117*b* slit
119 open roll side surface
120 opening

121 inner circumferential surface
122 partition plate
123 side surface
124, 224, 324 waterchannel
125, 225, 325 feed pipe
125*a* branch pipe
126, 226, 326 drain pipe
126*a* branch pipe
127 partition plate
128, 228 fin
133 cooling roll
134 through hole
135 convex portion
136 flange
137 drain outlet
138 entrance portion
139 water supply pipe
141, 141*a*, 141*b*, 241*a*, 241*b*, 341*a*, 341*b* bearing
142, 242, 342 watertank
143, 243, 343 cooling unit
144 valve
213*a*, 213*b*, 313*a*, 313*b* cooling zone
218 heat insulating zone
231, 331 supporting mechanism
232, 332 central part
318 forbidden zone
A molten alloy
P puddle
R Region
S foil strip
W cooling water

BEST MODES FOR CARRYING OUT THE INVENTION

Hereinafter, embodiments of the invention will be described with reference to the drawings.

First of all, a first embodiment of the invention will be described.

Figure 2:
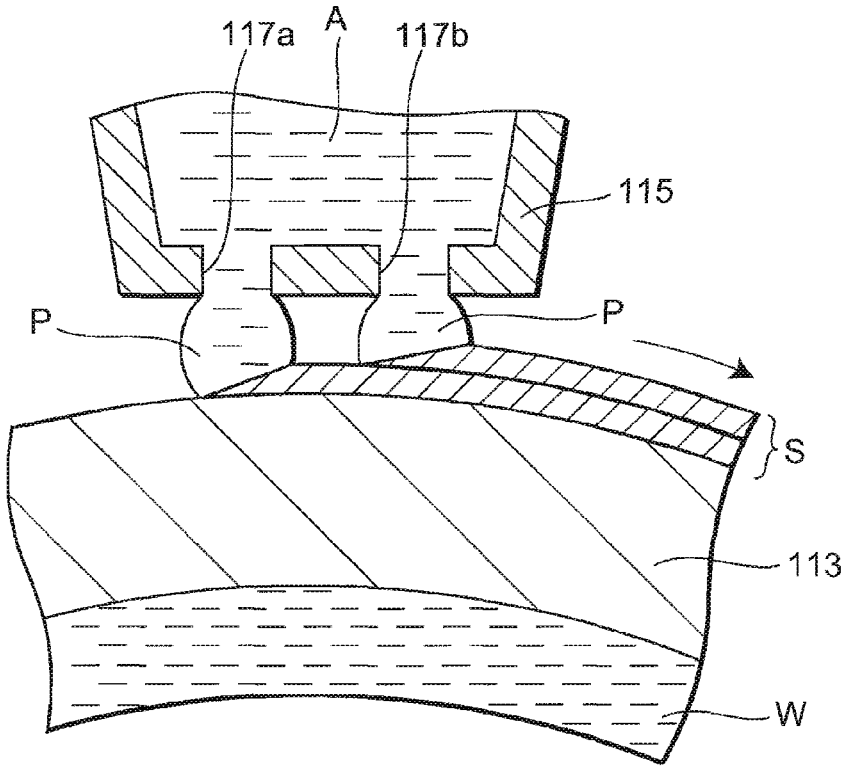
FIG. 2 is a cross-sectional view illustrating a portion where a molten alloy comes in contact with a cooling roll in FIG. 1.
Figure 3:
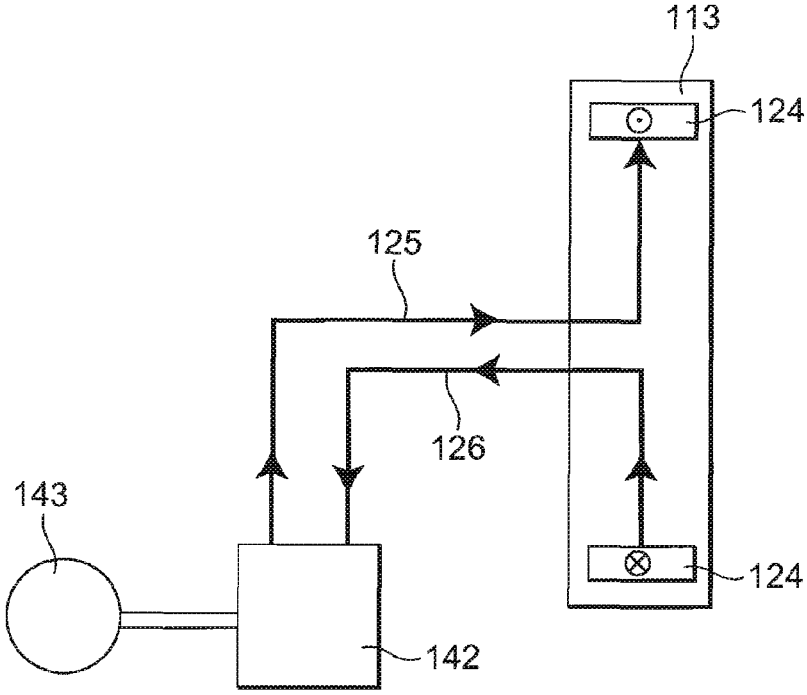
FIG. 3 is a conceptual diagram illustrating a pathway of cooling water circulated in the cooling roll in FIG. 1.

FIG. 1 is a front view illustrating a production apparatus for an amorphous alloy foil strip according to this embodiment. FIG. 2 is a cross-sectional view illustrating a portion where a molten alloy comes in contact with a cooling roll in FIG. 1. FIG. 3 is a conceptual diagram showing a pathway of cooling water circulated in the cooling roll in FIG. 1.

As shown in FIG. 1, a production apparatus 101 for an amorphous alloy foil strip according to this embodiment is configured to mainly produce an iron-base amorphous alloy foil strip (hereinafter also simply referred to as a "foil strip") S. The production apparatus 101 includes two cooling rolls 113*a* and 113*b* (hereinafter also collectively referred to as "cooling rolls 113") which are located in both sides of a driving unit 111. The cooling rolls 113*a* and 113*b* are rotatably supported by rotating shaft members 112*a* and 112*b*, respectively. A motor (not shown) is embedded in the driving unit 111 and is configured to rotate the cooling rolls 113 via a pair of the rotating shaft members 112*a* and 112*b*. The rotating shaft members 112 and the cooling rolls 113 are supported by bearings 141, 141*a*, and 141*b*. The cooling rolls 113*a* and 113*b* are made of metal or an alloy having high thermal conductivity, and are made of, for example, copper or a copper alloy.

The production apparatus 101 is provided with a crucible 114 for retaining a molten alloy A (see FIG. 2), and a nozzle 115 for ejecting the molten alloy A in the crucible 114 to outside of the crucible 114 is fitted to a lower end of the crucible 114. Here, the crucible is not limited to the one shown in FIG. 1 and includes all measures for storing and supplying molten metal. For example, a device capable of receiving the molten metal from an alloy melter and supplying the alloy to the cooling roll through a nozzle will be called the crucible. An apparatus configured to provide a melter with a nozzle and capable of directly supplying the molten metal is also included in the crucible.

Further, the production apparatus 101 is provided with a moving unit 116 extending in a direction from the cooling roll 113*a* toward the cooling roll 113*b*. Accordingly, the crucible 114 is guided by the moving unit 116 and is movable between a position where the molten alloy A can be ejected from a perpendicular direction relative to an outer circumferential surface of the cooling roll 113*a*, and a position where the molten alloy A can be ejected from a perpendicular direction relative to an outer circumferential surface of the cooling roll 113*b*. An ejection port of the nozzle 115, that is, a slit is oriented in the perpendicular direction relative to the outer circumferential surfaces of the rolls and a slight clearance is maintained with the outer circumferential surface of the cooling roll 113*a* or 113*b*. The crucible 114, the nozzle 115, and the moving unit 116 constitute a supplying unit for the molten alloy A.

As shown in FIG. 2, the nozzle 115 is a multiple-slit nozzle. Specifically, the shape of the ejection port of the nozzle 115 is formed into a shape in which multiple slits, e.g., two slits 117*a* and 117*b*, are arranged along a circumferential direction of the cooling rolls 113. The longitudinal direction of each of the slits 117*a* and 117*b* is identical to an axial direction (a roll width direction) of the cooling rolls 113. The distance between the slits 117*a* and 117*b* is, for example, set equal to or below 10 mm (millimeters), and is, for example, equal to or below 6 mm. Here, a multiple-slit nozzle including three or more slits formed at the ejection port or a single-slit nozzle provided with only one slit may be used as the nozzle 115.

The nozzle 115 is made of a refractory material which is less wettable to the molten alloy A, and is made of boron nitride, zirconia or alumina, for example. In this way, the slits are prevented from being clogged with the molten alloy A, i.e., configured to eject it smoothly. Besides these refractory materials, a refractory material that allows permeation of the molten alloy can be used as the material of the nozzle 115 if a surface thereof is coated with a substance which is less wettable to the molten alloy by thermal spray or the like. For example, silicon nitride or the like has excellent strength and thermal shock. A composite material of silicon carbide and boron carbide has electric conductivity in addition to heat resistance and facilitates heat retention of the nozzle in a standby state. However, these materials react with iron inside the molten alloy and therefore need to be coated with the above-described less wettable material such as boron nitride, zirconia or alumina.

FIG. 3 shows a simplified pathway of cooling water W in the production apparatus 101. In FIG. 3, the cooling water W for cooling down the cooling roll 113 is supplied using a pump (not shown) from a water tank 142 to a water channel 124 inside the cooling rolls via a feed pipe 125, and after circulation in the water channel 124, is returned to the water tank via a drain pipe 126. In order to retain the cooling water lower than a predetermined temperature such as a room temperature during casting, a cooling unit 143 configured to cool the cooling water W down is provided in the course of the pathway of the cooling water W, e.g., in the water tank 142. The cooling unit 143 may be a unit applying a heat pump, a unit for feeding a material such as ice which has a lower temperature than the room temperature, and so forth.

Next, operations of the production apparatus 101 according to this embodiment configured as described above, that is, a method for producing an amorphous alloy foil strip according to this embodiment will be described.

First, as shown in FIG. 1, the cooling rolls 113*a* and 113*b* are rotated by way of the rotating shaft members 112*a* and 112*b* by driving the driving unit 111. Next, the molten alloy A is ejected from the crucible 114 to the outer circumferential surface of one of the cooling rolls 113*a* through the nozzle 115 which is closely located at a predetermined interval. In this way, a puddle P is formed between the nozzle 115 and the cooling roll 113*a*. Then, a portion of the molten alloy forming the puddle P, which contacts the cooling roll, is cooled down so as to increase viscosity and is drawn out of the puddle P by rotation of the cooling roll 113*a*. The alloy thus drawn out is a supercooled liquid at this point, but is quenched by the roll down to a glass transition temperature or below and is formed into the amorphous alloy foil strip S. A cooling rate required for rendering the foil strip (or the supercooled liquid) drawn out of the puddle amorphous is equal to or above $1\times10^{5}$° C./sec. in the case of the iron-base alloy, for example.

In this embodiment, two slits 117 are formed in the nozzle 115 as shown in FIG. 2. For this reason, the sheet thickness of the formed foil strip becomes thicker than the case of using a single slit even if a circumferential velocity of the cooling roll is the same. That is, productivity is high. The sheet thickness with the multiple-slit nozzle is thicker than that with the single-slit nozzle under the condition of the same roll circumferential velocity. This is because a contact area with a cooling zone is increased by splitting the puddles P into multiple portions, and thereby a heat flow to be transmitted to the cooling zone can be dispersed.

The heat transmitted from the molten alloy and the foil strip to the cooling roll 113*a* in order to form the amorphous alloy foil strip is transferred from the outer circumferential portion of the cooling roll 113*a* inward and transmitted to the cooling water W circulated inside the water channel. That is, the heat of the molten alloy A is discharged by way of the molten alloy A→the cooling roll 113*a*→the cooling water W.

Figure 4:
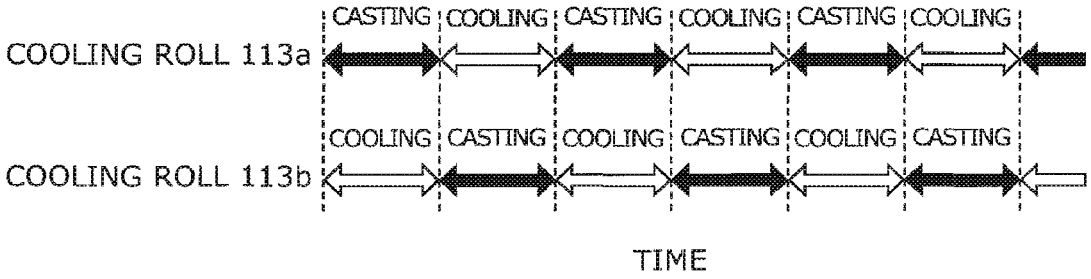
FIG. 4 is a timing chart illustrating a method for producing an amorphous alloy foil strip according to the first embodiment, in which a horizontal axis indicates time and a vertical axis indicates cooling rolls.

When the temperature of the cooling roll 113*a* reaches a predetermined value along with casting of the foil strip S, the nozzle 115 is closed to stop ejection of the molten alloy A. Next, the crucible 114 is moved along a rail of the moving unit 116 and the nozzle 115 is disposed close to the outer circumferential surface of the other cooling roll 113*b*. Subsequently, the nozzle 115 is opened again to eject the molten alloy A toward the outer circumferential surface of the cooling roll 113*b*. In this way, a foil strip S is cast with the cooling roll 113*b* by the same operation as the operation with the cooling roll 113*a*. In other words, as shown in FIG. 4, the cooling roll used for casting the foil strips S is switched from the cooling roll 113*a* to the cooling roll 113*b*. Although the cooling roll 113*a* is in a standby state in this period, the cooling water W is continuously supplied to the cooling roll 113*a* as well to cool the cooling roll 113*a* down.

Further, when the temperature of the cooling roll 113*b* reaches the predetermined value, the cooling roll used for casting the foil strips S is switched from the cooling roll 113*b* to the cooling roll 113*a*. By this time, the cooling roll 113*a* is cooled down to the temperature before casting so that it is possible to resume casting the foil strip S. Here, the cooling water W is continuously supplied to the cooling roll 113*b* in the standby state as well in this period to continue cooling. Likewise, as shown in FIG. 4, the cooling roll 113*a* and the cooling roll 113*b* are alternately used thereafter to continue production of the foil strips S.

In this way, it is possible to continue production of the foil strips S always by use of the cooling rolls at the temperature equal to or below the predetermined value by alternating the processes of supplying the molten alloy A to the outer circumferential surface of the cooling roll 113*a* while rotating the cooling roll 113*a* and cooling the cooling roll 113*a* down without supplying the molten alloy A to the outer circumferential surface of the cooling roll 113*b*.

Examples of numerical values in this embodiment will now be shown below.

Figure 5:
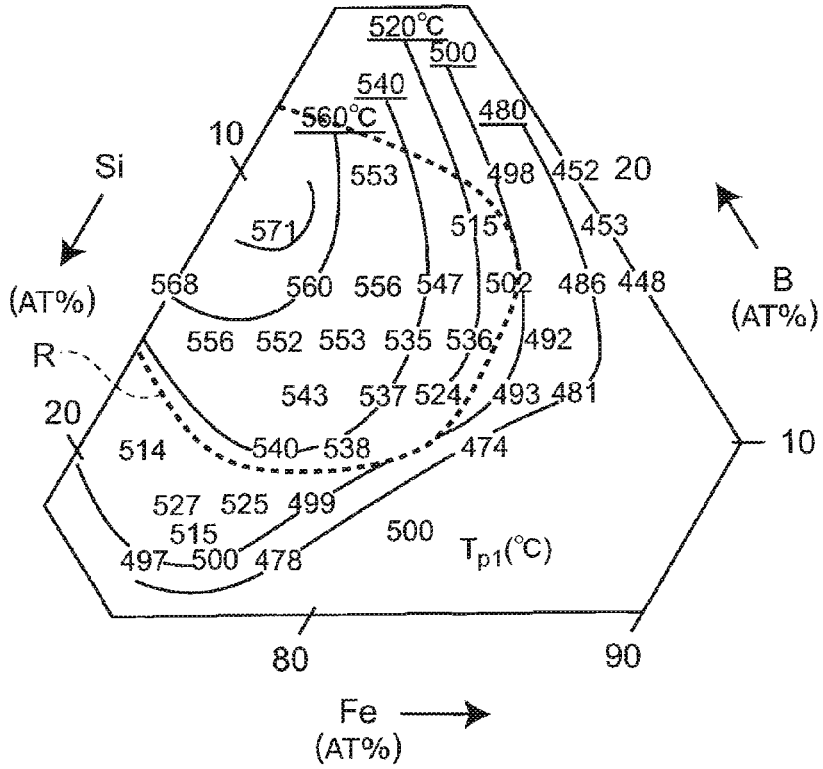
FIG. 5 is a ternary composition diagram illustrating a composition of an iron-base amorphous alloy foil strip to be produced in the embodiment.

FIG. 5 is a ternary composition diagram illustrating a composition of the iron-base amorphous alloy foil strip to be produced in this embodiment. The iron-base amorphous alloy foil strip S to be produced in this embodiment has a width, for example, equal to or above 60 mm and a thickness (a sheet thickness), for example, equal to or above 30 μm (micrometers), e.g., equal to or above 33 μm, and, e.g., equal to or above 40 μm. Here, in this specification, the thickness of the foil strip is defined by use of a weight sheet thickness. The weight sheet thickness is a value obtained by dividing the weight of the foil strip by the area and the density of the foil strip.

As shown in FIG. 5, the composition of this iron-base amorphous alloy foil strip S is achieved by adding, for example, metalloids, i.e., silicon (Si) and boron (B), to iron (Fe). When using this foil strip S for an electromagnetic application, it is preferable to set the concentration of iron equal to or above 70 at %. For example, the composition of the foil strip is set to a concentration located in a region R surrounded by a dashed line in FIG. 5, i.e., the content of iron in a range from 70 to 81 at %, the content of silicon in a range from 3 to 17 at %, the content of boron in a range from 9 to 23 at %, and a glass transition temperature Tg equal to or above 500° C. Here, a sum of iron, silicon, boron, and unavoidable impurities is equal to 100 at %. Here, part of iron may be replaced by cobalt (Co) or nickel (Ni). The amount of replacement is set equal to or below 20 at % in total. Also, part of silicon or boron may be replaced by carbon which is equal to or below 2.0 at %. It is to be noted, however, that the amount of replacement by carbon is set within the range where the glass transition temperature Tg is equal to or above 500° C. In other words, the composition of the molten alloy A may be set to the composition in which the content of iron is set in a range from 70 to 81 at %, the content of silicon is set in a range from 1 to 17 at %, the content of boron is set in a range from 7 to 23 at %, the content of carbon is set equal to or below 2 at %, and the glass transition temperature Tg is set equal to or above 500° C.

The reason for defining the glass transition temperature Tg as the prerequisite for selecting the composition is as follows. Previously, ease of forming an amorphous alloy (glass forming ability) has been evaluated by a ratio (Tg/Tm) between the melting point Tm of the alloy and the glass transition temperature Tg (which is the absolute temperature in this case). However, in reality, the glass transition temperature Tg exhibits more significant contribution than the melting point Tm and the region R of the alloy composition is therefore defined by the magnitude of Tg. When the glass transition temperature Tg of the alloy is raised by 50° C., the upper limit sheet thickness of the foil strip that can be amorphous is increased at least by 10%. Here, it is difficult to measure the glass transition temperature Tg in the case of an iron-base alloy. Accordingly, a crystallization peak temperature $T_{p1}$ that is deemed to be almost the same temperature is used instead. The numerical values in FIG. 5 represent the crystallization peak temperatures $T_{p1}$ (° C.).

Of the compositions in the region R shown in FIG. 5, concrete compositions of groups having relatively high saturation magnetic flux densities Bs, i.e., the groups having the saturation magnetic flux densities Bs equal to or above 1.5 T (tesla), and of groups having low hysteresis losses are respectively shown in Table 1. The hysteresis loss is a hysteresis loss $Wh_{13}/_{50}$ at a frequency of 50 Hz (hertz) and at a magnetic flux density of 1.3 T. In Table 1, the value $Wh_{13}/_{50}$ of any of the compositions shown in the right column is equal to or below 0.08 W/kg when performing a heat treatment under optimum conditions. Here, the hysteresis loss $Wh_{13}/_{50}$ is the value measured by use of a single-sheet sample. Here, numbers indicated in Table 1 represent atomic percentage of the respective components.

TABLE 1

| Examples of Compositions Having High Saturation Magnetic Flux Densities | Examples of Compositions Having Low Hysteresis Losses |
|---|---|
| $Fe_{81}Si_6B_{13}$ | $Fe_{75}Si_{10}B_{15}$ |
| $Fe_{80}Si_6B_{14}$ | $Fe_{74}Si_{12}B_{14}$ |
| $Fe_{79}Si_6B_{15}$ | $Fe_{73}Si_{11}B_{16}$ |
| $Fe_{78}Si_6B_{16}$ | |
| $Fe_{77}Si_{10}B_{13}$ | |
| $Fe_{76}Si_{10}B_{14}$ | |
| $Fe_{76}Si_8B_{16}$ | |

The foil strip S may also contain in (Sn) in a range from 0.01 to 1.0 mass %. While crystallization of the foil strip is initiated from a surface thereof, in has a strong tendency to be segregated on the surface and exhibits an effect to suppress crystallization of a foil strip surface layer. In this way, deterioration in a magnetic characteristic associated with crystallization is suppressed. Moreover, in has an effect to suppress a variation of the magnetic characteristic with time.

Next, the production apparatus and the production method according to this embodiment will be described in detail.

Figure 6C:
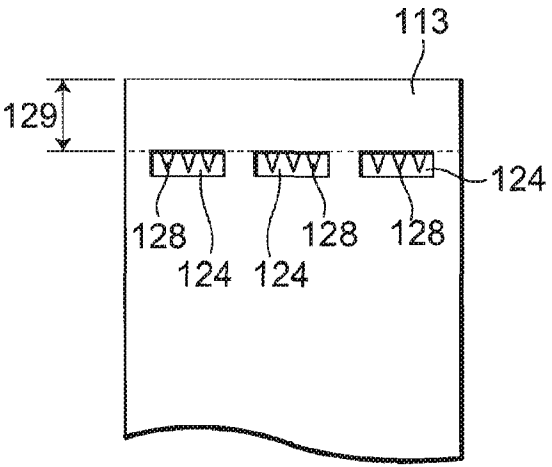
FIGS. 6A to 6C are explanatory diagrams defining the wall thickness of the cooling roll in the embodiment.
Figure 6B:
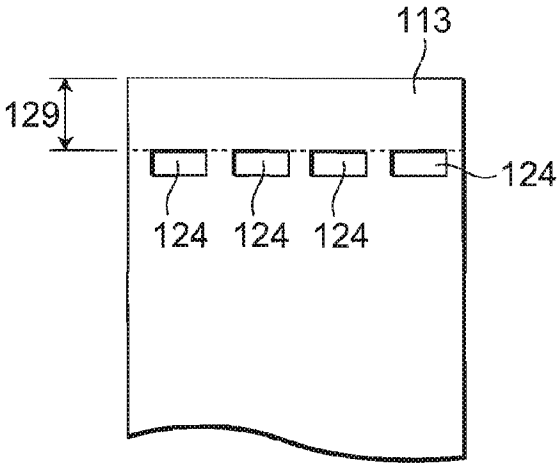
Figure 6A:
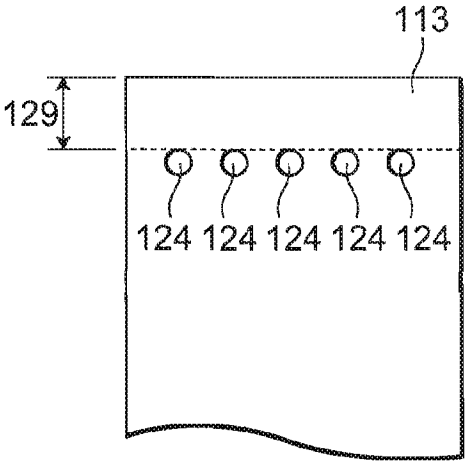

The cooling roll 113 preferably has a wall thickness equal to or above 25 mm. Here, as shown in FIGS. 6A to 6C, the wall thickness of the cooling roll 113 is equivalent to a distance from the outer circumferential surface of the cooling roll to an inner surface of the cooling roll contacting the cooling water. When a cross section orthogonal to the water channel 124 has a shape of a circular pipe, for example, a distance from a portion closest to the outer circumferential surface to the outer circumferential surface is defined as the wall thickness 129 of the cooling roll as shown in FIG. 6A. If the cross section of the water channel has any of a rectangular shape and a rectangular shape provided with fins 128, then distances shown in FIGS. 6B and 6C are respectively defined as the wall thickness 129 of the cooling roll.

Previously, the wall thickness of the cooling roll has been designed on the premise of continuous casting for a long time period. The thinner wall surface has been deemed to be more advantageous in light of heat discharge and a thickness equal to or below 10 mm has been adopted. For example, Patent Document 2 defines the wall thickness of a cooling roll (a cooling sleeve) in a range from 3 to 10 mm and describes the reason. According to the document, when the thickness exceeds 10 mm, there is a large drop in a cooling rate that intensifies local embrittlement of an amorphous alloy foil strip, and in particular, it is not possible to obtain a foil strip having a sheet thickness equal to or above 25 μm which can be bent fully. On the other hand, the thickness equal to or below 3 mm causes large thermal deformation of the cooling roll that leads to an uneven thickness of a quenched foil strip. Moreover, Patent Document 2 discloses a method of causing a jet of cooling water to run into an inner surface of a roll as a unit for thickening an amorphous alloy foil strip. However, this method still has a limited effect to increase a heat transfer coefficient between the roll and the water and therefore faces a difficulty in producing an amorphous alloy foil strip having a sheet thickness exceeding 30 μm.

Figures 7A, 7B:
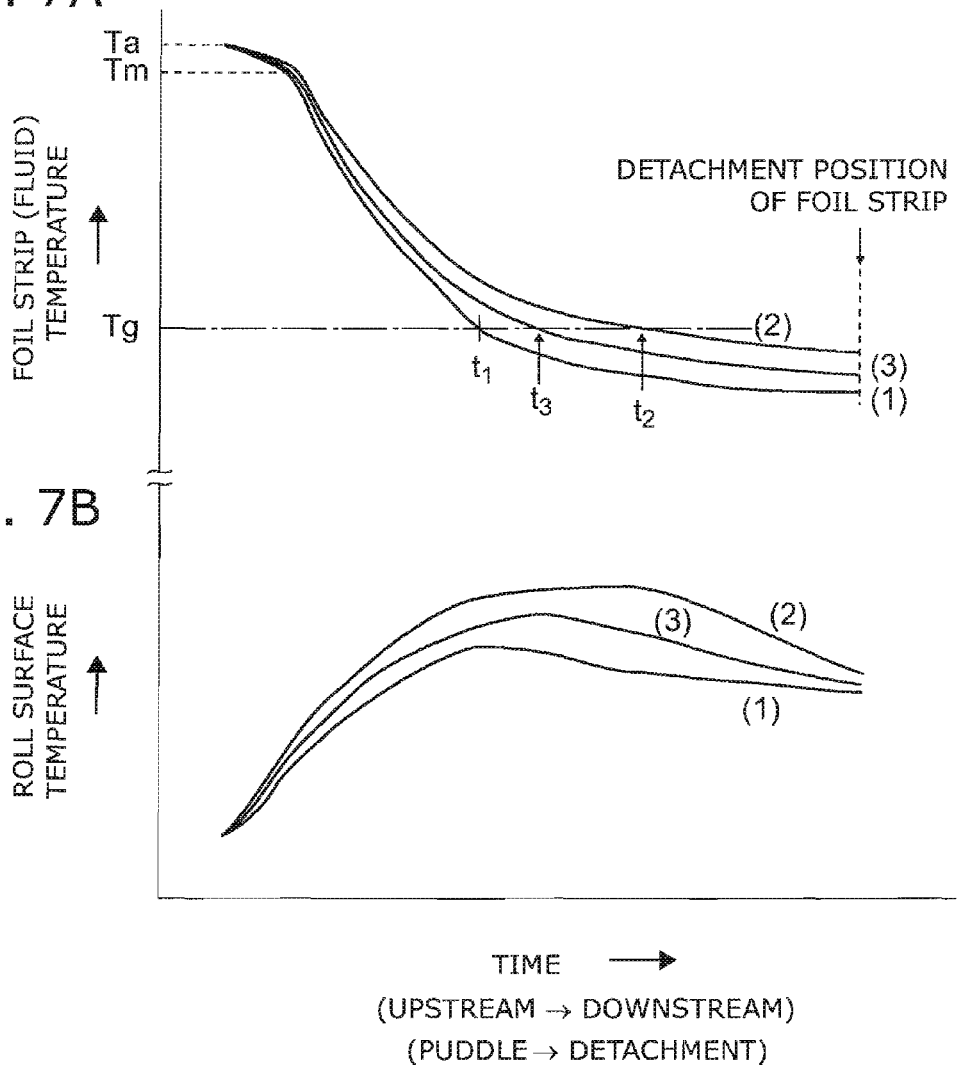
FIG. 7A schematically shows the time change of the temperature of a foil strip in the course of casting, and FIG. 7B schematically shows the temperature change of the surface of the cooling zone.

The reason why it is difficult to obtain a thick amorphous alloy foil strip by using the conventional cooling roll having a thin wall thickness will be described based on experimental knowledge and heat transfer calculation. FIG. 7A schematically shows the time change (corresponding to a distance in a downstream direction from the puddle) of the temperature of a foil strip in the course of casting (including an unsolidified fluid) and FIG. 7B schematically shows the temperature change of the surface of the cooling roll. Concerning respective curved lines in the drawing, a line (1) indicates a case of producing a thin foil strip (e.g., 25 μm) by using a cooling roll having a small wall thickness (the conventional method, e.g., 10 mm), a line (2) indicates a case of producing a thick foil strip (e.g., 40 μm) by using the cooling roll having a small wall thickness (the conventional method, e.g., 10 mm), and a line (3) indicates a case of producing the thick foil strip (e.g., 40 μm) by using a cooling roll having a large wall thickness (this embodiment, e.g., 30 mm).

As shown in FIG. 7A, the curved line (1) indicating the temperature change of the foil strip represents the case of producing the thin foil strip by use of the roll having a small wall thickness, in which time $t_1$ lapsed from the melting point Tm of the alloy to the glass transition temperature Tg is sufficiently shorter than critical time for vitrification tg and the foil strip is cooled down at a cooling rate that is necessary for forming the amorphous body. On the other hand, the line (2) represents the case of producing the thick foil strip by use of the same roll having a small wall thickness, in which a gradient of the temperature curve is reduced as compared to the gradient of the line (1) when the line comes close to the glass transition temperature Tg. Accordingly, time $t_2$ lapsed from Tm to Tg becomes longer than tg. That is, it is not possible to obtain the cooling rate necessary for forming the amorphous body.

On the other hand, the cooling curve in the case of producing the thick foil strip by use of the cooling roll having a thick cooling zone as in this embodiment is formed into the line (3), which has reduction in the gradient in the vicinity of the glass transition temperature Tg smaller than the condition of the line (2). Accordingly, the time $t_2$ to reach Tg becomes shorter than tg and the foil strip is cooled down at the cooling rate necessary for forming the amorphous body, thereby forming the thick amorphous alloy foil strip.

The sheet thickness of the amorphous alloy foil strip, which is intended to be produced, constitutes a basis for designing the wall thickness of the cooling roll. The wall thickness of the cooling roll 113 is increased depending on the sheet thickness of the foil strip. It is preferable to set the wall thickness of the cooling roll 113 equal to or above 25 mm in order to form the thick foil strip having a sheet thickness equal to or above 30 μm. For example, the wall thickness of the cooling roll 113 is set equal to 30 mm when the sheet thickness of the foil strip S is in a range from 30 to 45 μm. The wall thickness of the cooling roll is set equal to 50 mm when the sheet thickness of the foil strip S is in a range from 45 to 60 μm. The wall thickness of the cooling roll is set equal to 100 mm when the sheet thickness of the foil strip S is in a range from 60 to 120 μm.

In this embodiment, the circumferential velocity of the cooling roll is set in a range from 10 to 30 m/sec., for example, 20 m/sec. In an alternate casting method using twin rolls as in this embodiment, timing for change is set up depending on the surface temperatures of the cooling rolls 113, for example.

When the temperature on a puddle upstream side of the cooling roll 113*a* reaches 200° C., for example, the cooling roll used for casting is changed to the cooling roll 113*b*. At this time, a measurement position for the temperature of the cooling roll is defined in a position located 20 cm away on an upstream side from the nozzle 115, for example. Alternatively, if the sheet thickness, the width, and casting conditions of the foil strip S are constant, it is also possible to change based on a numerical value measured in advance.

When producing the amorphous alloy foil strips only by use of a single cooling roll as in the conventional case, it is extremely difficult to continuously produce the foil strips having a sheet thickness larger than 30 μm. No matter how favorably the shape, the size, and a cooling mechanism of the cooling roll are designed within practical ranges, the temperature of the outer circumferential surface of the cooling roll continues to rise along with casting time. Then, if the temperature of the outer circumferential surface of the cooling roll rises above the aforementioned critical temperature (e.g., 200° C.), the cooling rate necessary for forming the amorphous body becomes unavailable and the foil strips begin to crystallize.

Figure 8:
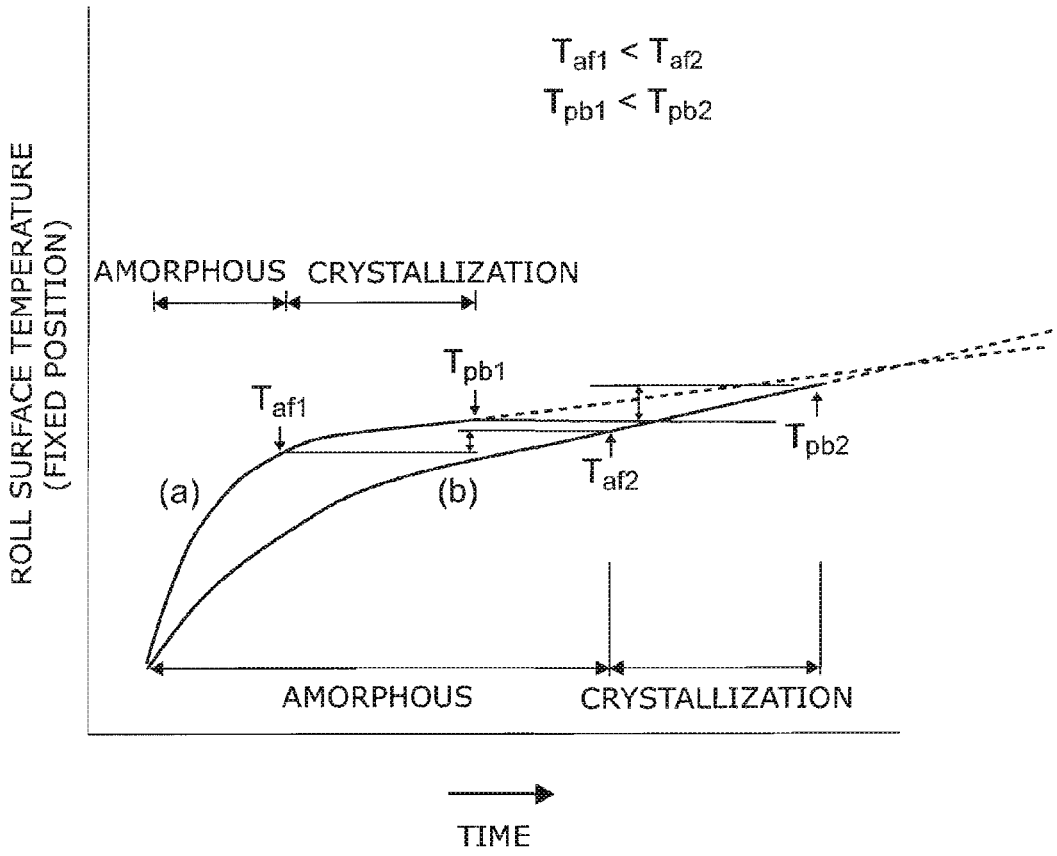
FIG. 8 is a schematic view comparing the time change of the temperature of the roll surface in the course of casting a thick foil strip between (a) the case of using a roll having a small wall thickness and (b) the case of using a roll having a large wall thickness.

Description will be made by use of FIG. 8 in order to help understanding the above-described heat transfer behavior. FIG. 8 schematically shows transition of the temperature of the outer circumferential surface of the cooling roll when producing (a) the thick foil strip (e.g., a sheet thickness of 40 μm) by using the cooling roll having a small wall thickness (e.g., a wall thickness of 10 mm), and (b) the thick foil strip (e.g., a sheet thickness of 40 μm) by using the cooling roll having a large wall thickness (e.g., a wall thickness of 30 mm). The measurement position for the temperature is defined in a position located on an upstream of the puddle, or a position located 20 cm distant from the puddle, for example. In this specification, either the cooling roll having a large wall thickness or simply a thick wall roll means the cooling roll having a wall thickness equal to or above 25 mm. Also, a conventional thin wall roll means the cooling roll having a wall thickness around 10 mm or less.

As shown in (a) and (b) in FIG. 8, in any of the case of using the thin wall roll and the case of using the thick wall roll, the temperature rises rapidly at an initial stage of casting. Then, the rate of temperature rise is stabilized but the temperature continues to rise linearly at a certain gradient.

In the case of the cooling roll having a small wall thickness, a microscopic structure of the foil strip to be formed remains amorphous up to a roll surface temperature $T_{af1}$ but crystallization begins in excess thereof. As time advances further, a puddle break occurs at $T_{pb1}$ and no foil strips will be formed thereafter. Although the same tendency applies in the case of the cooling roll having a large wall thickness, the time to the start of crystallization and the time to occurrence of the puddle break are considerably extended.

Moreover, both of the surface temperature $T_{af}$ of the cooling roll at which crystallization begins and the roll surface temperature $T_{pb}$ at which the puddle break occurs become higher in the case of the thick wall roll. That is, $T_{af1}<T_{af2}$ and $T_{pb1}<T_{pb2}$. The reason is that the thick wall portion of the thick wall roll has a heat storage effect. Although a quench is required in the temperature zone from the melting point Tm to the glass transition temperature Tg in order to form the amorphous body, the conventional thin wall roll cannot deal with the quench when the foil strip becomes thicker. Even if a diameter of the roll is increased, it is not possible to absorb a heat flow in the above-mentioned temperature zone because the thin wall roll has a small heat capacity.

Moreover, the thick wall roll has large cooling power even when the temperature of the outer circumferential surface of the roll is high. The reason is that the heat flows more three-dimensionally in the thick wall roll (see arrows representing the heat flow in FIGS. 9A and 9B).

Figure 9A:
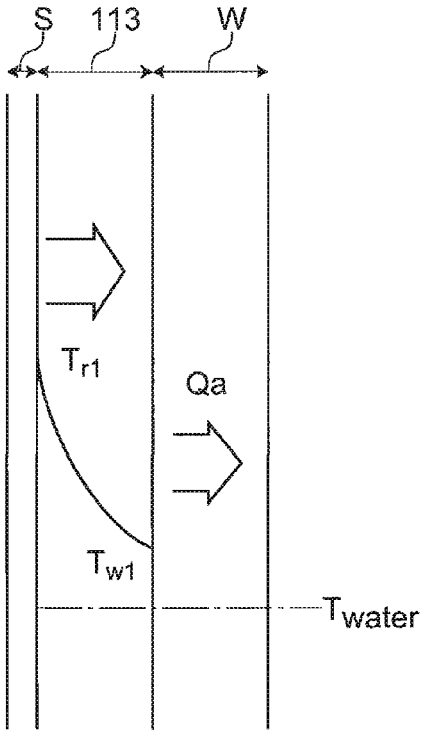
FIGS. 9A and 9B are schematic views illustrating the temperature change of a thick wall direction of the cooling roll in the course of casting an amorphous alloy foil strip, in which (a) shows the thin wall roll and (b) shows the thick wall roll.
Figure 9B:
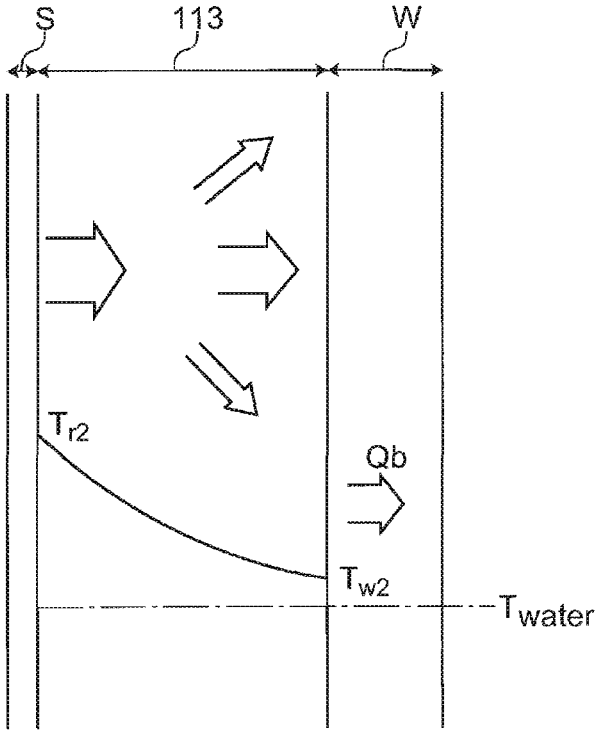

FIGS. 9A and 9B are views schematically showing temperature distribution in the direction of the wall thickness of the cooling roll immediately below the foil strip at one point in the temperature zone in which the temperature of the foil strip transits from Tm to Tg when casting the thick foil strip. FIG. 9A shows the thin wall roll and FIG. 9B shows the thick wall roll. As shown in FIG. 9A, regarding the thin wall roll, the temperature of the outer circumferential surface of the roll is high and the temperature of the inner surface of the roll that contacts the cooling water is also high. On the other hand, as shown in FIG. 9B, both of a temperature $T_{r2}$ of the outer circumferential surface and a temperature $T_{w2}$ of the inner surface of the thick wall roll are lower than those $T_{r1}$ and $T_{w2}$ of the thin wall roll because the heat is widely diffused in a semi-three-dimensional manner in the case of the thick wall roll. As the inner surface temperature of the thick wall roll is lower than that of the thin wall roll, the amount of discharged heat between the roll and cooling water become Qa>Qb, and hence the cooling efficiency of the cooling water becomes lower in the case of the thick wall roll. However, the thick wall cooling zone has a larger heat capacity to be stored in the thick wall portion, whereby the time from the start of casting to the start of crystallization becomes longer.

As described above, the thick wall roll can store a large amount of heat temporarily by way of its own heat capacity. A large part of the heat stored in the thick wall portion of the cooling roll is transmitted and discharged to the cooling water while the roll goes around. However, part of the heat is accumulated in the cooling roll and raises the roll temperature. In order to accelerate the heat discharge from the cooling roll to the cooling water W, it is effective to increase the diameter and the width of the roll. Moreover, it is effective to maintain the cooling water at a low temperature. It is possible to extend the time available for continuous casting by taking these measures.

The diameter and the width of the cooling roll 113 can be designed based on the above-described heat transfer mechanism. Specifically, as the thick wall portion of the cooling roll 113 becomes thicker, the gradient of the straight line portion in the temperature curve of the outer circumferential surface of the cooling roll shown in FIG. 8 becomes larger. In order to reduce this gradient and to extend the time to a casting change, it is effective to increase the diameter and the width of the cooling roll 113. This is because time within one round to allow the inner surface of the cooling roll to contact the cooling water becomes longer by increasing the diameter of the cooling roll 113 and the amount of heat to be transmitted from the cooling roll to the cooling water is thereby increased.

In this embodiment, the diameter of the cooling roll 113 is set preferably in a range from 0.4 to 2.0 m. It is possible to ensure sufficient time within one round of the cooling roll by setting the diameter of the cooling roll 113 equal to or above 0.4 m. As a result, the heat transmitted from the molten alloy to the outer circumferential surface of the cooling roll 113 is efficiently discharged to the cooling water. In the meantime, by setting the diameter of the cooling roll 113 equal to or below 2.0 m, it is possible to facilitate an operation while avoiding an excessive increase in size of the production apparatus 101. Moreover, it is possible to facilitate ensuring strength of mechanical portions such as the bearings of the cooling roll 113.

It is preferable to set the width of the cooling roll 113 equal to 1.5 times or more of the width of the foil strip S, which is intended to be produced. In this way, the heat transmitted from the molten alloy A to the cooling roll 113 is also spread in the width direction and the amount of heat discharged to the cooling water for each round of the cooling roll is increased.

It is preferable to cool the cooling water W down in order to further enhance the cooling efficiency of the cooling roll. The temperature of the cooling water W to be supplied into the cooling roll 113 is set preferably equal to or below 20° C. or more preferably equal to or below 10° C. Because, as the temperature of the cooling water is lower, it is possible to cool the cooling roll 113 down efficiently, thereby increasing the sheet thickness of the producible amorphous alloy foil strip. It is also possible to lower the freezing point by dissolving solute in the cooling water so as to set the temperature of the cooling water W equal to or below 0° C. upon supply into the cooling roll 113.

There may be a risk of causing dew condensation if the temperature of the outer circumferential surface of the cooling roll 113 becomes lower than a room temperature. In order to prevent dew condensation, gas that contains no moisture such as dry air or nitrogen may be sprayed onto the outer circumferential surface of the cooling roll. The spray of the gas should take place before the start of casting. Once the casting is started, the temperature of the outer circumferential surface of the cooling roller exceeds the room temperature soon, so it is no longer necessary to spray the gas.

Further, a material of the cooling roll 113 preferably has a large thermal conductivity. For example, the material has the thermal conductivity preferably equal to or above 250 W/mK, and more preferably equal to or above 300 W/mK. However, the material having the large thermal conductivity tends to have poor mechanical strength or abrasion resistance. Therefore, if the strength or hardness of the circumferential surface of the cooling roll is inadequate, it is also possible to harden only a surface layer of the circumferential portion. Hardening of the surface layer can be achieved by ion implantation, for example. In this case, it is preferable to provide implanted ions with a concentration gradient in order to prevent occurrence of a crack attributable to a heat stress.

The nozzle 115 used in production of the amorphous alloy foil strip according to this embodiment is a slit nozzle, and the width of a slit measured along the circumferential direction of the cooling roll 113 is in a range from 0.2 to 1.2 mm, e.g., in a range from 0.3 to 0.8 mm. Regarding the type of the slit, a single slit is acceptable but multiple slits are more preferable in light of productivity. From an empirical point of view, the sheet thickness is inversely proportional to the roll circumferential velocity. Therefore, in the case of the single-slit nozzle, it is necessary to set up the circumferential velocity slower than that of the multiple-slit nozzle. The circumferential velocity of the cooling roll 113 is set, for example, in a range from 10 to 30 m/sec., e.g., in a range from 15 to 25 m/sec. A distance (a gap) between the nozzle 115 and the outer circumferential surface of the cooling roll is set, for example, in a range from 0.1 to 0.5 mm, e.g., in a range from 0.15 to 0.25 mm. An ejection pressure of the molten alloy A is set, for example, in a range from 10 to 40 kPa, e.g., in a range from 20 to 30 kPa.

When starting the supply (pouring) of the molten alloy A onto the outer circumferential surface of the cooling roll 113 via the nozzle 115, the temperature of the outer circumferential surface of the cooling roll is gently increased except immediately after the start of pouring. Even if the temperature of the outer circumferential surface of the cooling roll 113 is increased, the sheet thickness of the foil strip remains almost constant as long as the temperature is equal to or below 200° C., for example, thereby ensuring the cooling rate necessary for forming the amorphous body. That is, the amorphous alloy foil strip S is obtained. Here, measurement of the temperature of the outer circumferential surface of the cooling roll is performed in a position in the center of the roll width and located 20 cm away on the upstream side from the puddle P. A contact-type thermometer is used for measuring the temperature of the outer circumferential surface of the cooling roll, for example. A concrete example is disclosed in Patent Document 3.

The timing to change casting may also be determined by measuring a surface temperature of the formed foil strip S. A position of measurement is preferably located in an appropriate position prior to detachment of foil strip S from the cooling roll. Although the above-described contact-type thermometer is applicable to this measurement, it is also possible to use an infrared radiation thermometer in the case of the iron-base alloy. Monitoring the temperature of the foil strip S is a more straightforward measure for judging the amorphous property of the foil strip in the course of casting.

Here, in the production apparatus 101 according to this embodiment, it is also possible to use only one side of the cooling rolls 113 to perform casting intermittently. Specifically, casting of the foil strip is performed in a state of rotating the cooling roll and supplying the cooling water and then the supply of the molten alloy is stopped if the temperature of the outer circumferential surface of the cooling roll reaches a predetermined value. At this time, rotation of the cooling roll and the supply of the cooling water are continued. By stopping the casting and continuing the supply of the cooling water, the temperature of the outer circumferential surface of the cooling roll is rapidly cooled down. Thereafter, the casting is resumed at a time point when the temperature of the outer circumferential surface of the roll is back to the room temperature, for example. In this way, it is possible to produce the thick amorphous alloy foil strips in an industrial scale by use of the single cooling roll, although intermittently.

Next, effects of this embodiment will be described.

In this embodiment, the production apparatus 101 for an amorphous alloy foil strip is provided with the two cooling rolls 113*a* and 113*b* and the foil strips S are cast by alternately using these rolls. In this way, the single cooling roll repeats casting and cooling down, whereby it is possible to set the temperature equal to or below the predetermined value. As a result, it is possible to cast the amorphous alloy foil strip having a large sheet thickness almost continuously and to perform production in an industrial scale. Such an amorphous alloy foil strip is applicable to a power transformer or a core of a motor, for example, and is also applicable to a magnetic shield material.

Moreover, since the multiple-slit nozzle is used as the nozzle 115 in this embodiment, it is possible to equalize the sheet thickness of the foil strips S and to reduce occurrence of pin holes. A surface condition of the foil strip S is microscopically rough due to minute vibration of the puddle P, a local defect of the cooling roll 113, and the like. Significant roughness leads to formation of scale-like stripes called fish scales or of pin holes on the foil strips S, which are macroscopically observable. By using the multiple-slit nozzle method, these defects formed on a fluid layer drawn out of the puddle on the upstream side are compensated by the puddle on the downstream side. Therefore, it is possible to produce the foil strips S having favorable surface conditions with very few pin holes.

As described above, the surface of the amorphous alloy foil strip produced in accordance with the multiple-slit nozzle method is smooth with very few pin holes. A number density of pin holes on the foil strip is equal to or below 25 holes/$m^2$, for example, or equal to or below 10 holes/$m^2$, for example, or none, for example. A space factor is improved when stacking the foil strips due to the decrease of pin holes, the smoothed surface, and so forth. For example, according to this embodiment, the space factor becomes equal to or above 80% when the foil strip having a sheet thickness equal to or above 33 μm is produced and then a wound iron core is fabricated by using this foil strip; the space factor becomes equal to or above 85% when the foil strip having a sheet thickness equal to or above 40 μm is produced and then a wound iron core is fabricated by using this foil strip; and the space factor becomes equal to or above 90% when the sheet thickness is equal to or above 45 μm. Moreover, the space factor becomes equal to or above 93% in the case of the foil strip having a sheet thickness equal to or above 50 μm. The foil strip having the smooth surface and very few pin holes causes a smaller hysteresis loss as there are fewer obstacles for domain wall motion, and is therefore a favorable material for an electromagnetic iron core. In addition, an improvement in the space factor has the same significance as an improvement in a saturation magnetic flux density Bs. For example, an improvement in the space factor from 80% to 90% has practically the same effect as an improvement in Bs from 1.60 T to 1.78 T.

In this embodiment, the production apparatus 101 applies the cooling rolls 113 having a large wall thickness and mechanical strength of the cooling rolls is high. Accordingly, it is possible to minimize occurrence of variations in the sheet thickness and characteristics of the foil strip S attributable to uneven thermal expansion of the cooling rolls and to produce the homogeneous amorphous alloy foil strips. Also, by using the cooling rolls having a large wall thickness, it is possible to eliminate various problems that occur frequently in the case of the conventional thin wall rolls, which are attributable to uneven thermal deformation of the rolls. For example, local embrittlement or fluctuation in magnetic characteristics of the foil strips S due to uneven cooling of the foil strips or the like does not occur.

Next, a second embodiment of the invention will be described.

Figure 10:
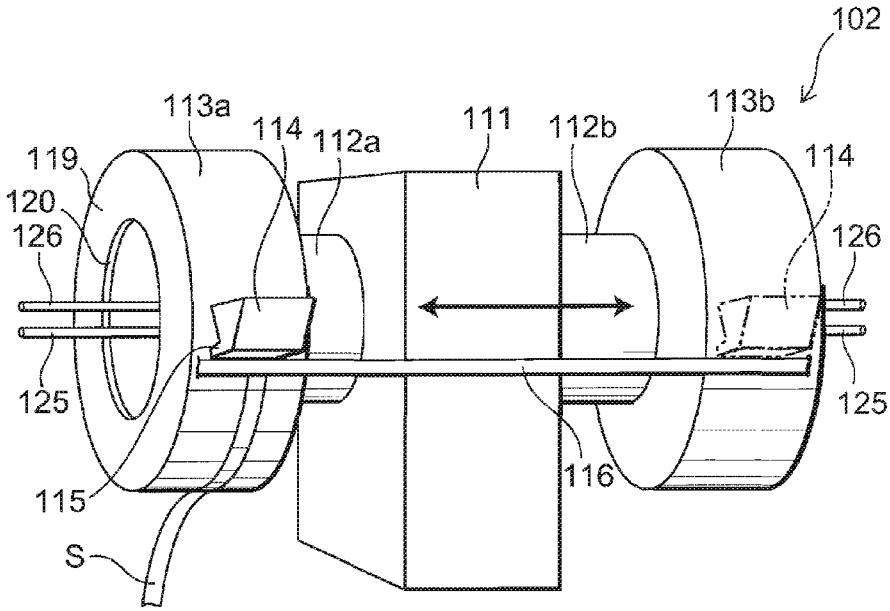
FIG. 10 is a perspective view illustrating a production apparatus for an amorphous alloy foil strip according to a second embodiment of the invention.

FIG. 10 is a perspective view showing a structure of cooling rolls 113. As shown in FIG. 10, in a production apparatus 102 for an amorphous alloy foil body, the cooling roll 113 is hollow and an opening 120 is formed at a central part of a side surface 119 on an opposite side (hereinafter referred to as a "water supply side") of a side where the driving unit 111 is disposed (hereinafter referred to as a "driving side"). The shape of the opening 120 is circular and a central axis thereof conforms to a central axis of the cooling roll 113. That is, the cooling roll 113 has a shape of an open roll.

Figure 11:
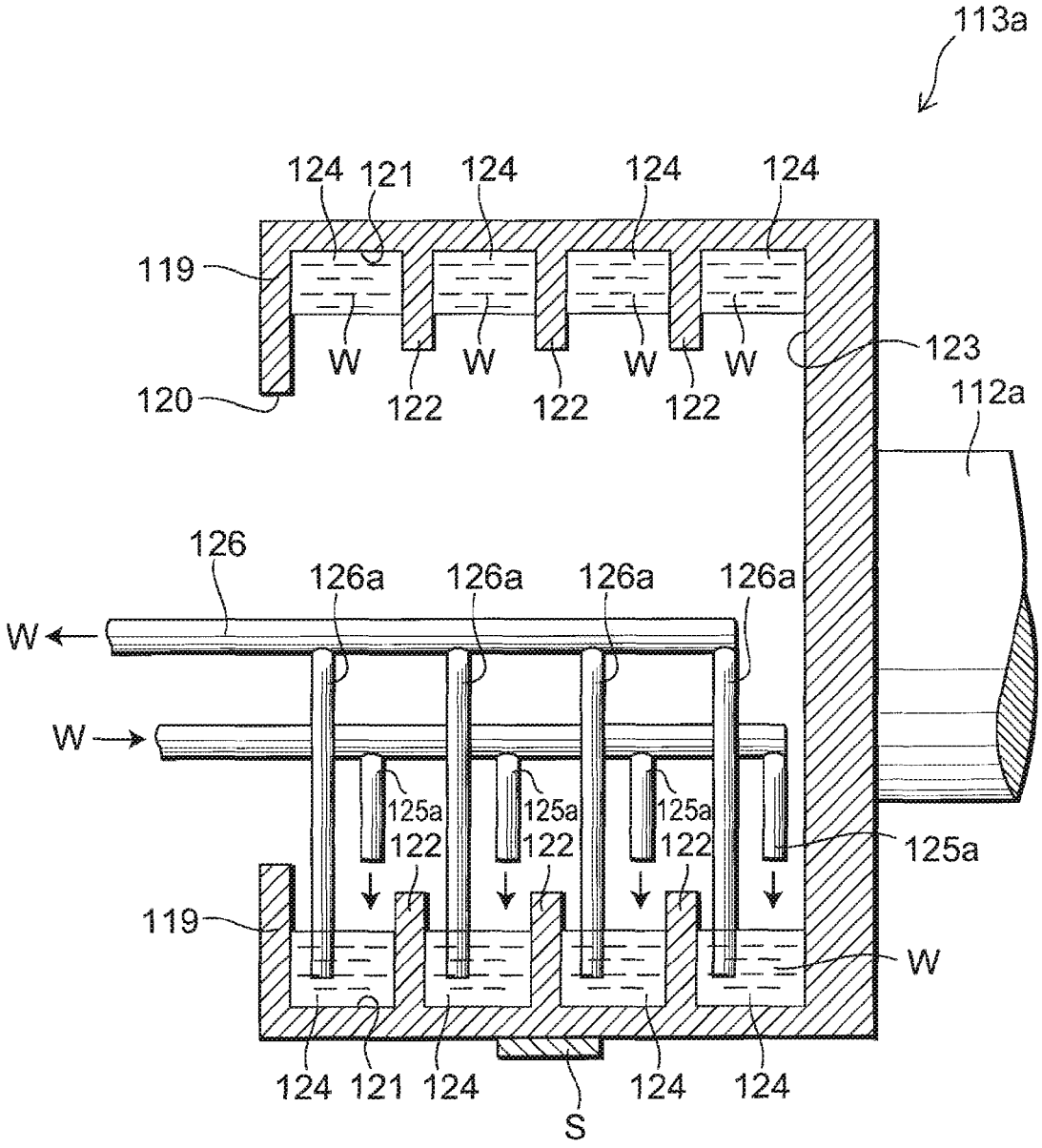
FIG. 11 is a cross-sectional view illustrating the vicinity of a cooling roll shown in FIG. 10.

A cross section of the cooling roll from the outer circumferential surface toward the central axis is shown in FIG. 11. On an inner circumferential surface 121 of the cooling roll in FIG. 11, multiple partition plates 122 extending along the circumferential direction of the cooling roll 113 and spaces defined by the side surface 119 on the water supply side, the multiple partition plates 122, and a side surface 123 on the driving side are respectively formed into water channels 124.

A water supply pipe 125 and a drain pipe 126 are brought into the cooling roll 113 via the opening 120. The water supply pipe 125 is connected to a water supply unit (not shown) and the drain pipe 126 is connected to a pump (not shown). Branch pipes 125*a* in the same number as the water channels 124 are branched off from the water supply pipe 125 and the cooling water is supplied to the respective water channels 124 via the respective branch pipes. Likewise, branch pipes 126*a* in the same number as the water channels 124 are branched off from the drain pipe 126 and the cooling water is discharged from the respective water channels 124 via the respective branch pipes 126*a*. A shape of a cross section orthogonal to a longitudinal direction in the branch pipe 126*a* has a streamlined shape along the circumferential direction of the cooling roll 113, for example. In this way, the cooling roll 113 functions as a water-cooled roll configured to circulate the cooling water W inside.

Next, operations of the second embodiment will be described.

First, as shown in FIG. 10, the cooling rolls 113*a* and 113*b* are rotated by way of the rotating shaft members 112*a* and 112*b* by driving the driving unit 111. At this time, the rotating speed of the cooling rolls 113 is set to a rotating speed so as to render a centrifugal force in the waterchannels 124 greater than the gravity.

In this state, as shown in FIG. 11, the cooling water W is supplied to the respective water channels of the cooling rolls 113*a* and 113*b* via the water supply pipes 125. In this way, the cooling water W inside the respective water channels 124 is rotated together with the cooling rolls 113 and reaches all parts of the water channels 124. That is, the cooling water W sticks to the inner surfaces of the cooling rolls 113 by the centrifugal force and does not fall off even at upper parts of the cooling rolls 113. At this time, tip ends of the branch pipes 126*a* are inserted to the cooling water W.

On the other hand, the cooling water is discharged from the respective water channels 124 via the drain pipe 126 by operating the pump (not shown). In this way, a constant amount of the cooling water W is retained inside the cooling rolls 113. At this time, since the water channels 124 are open toward the center of the cooling rolls 113, surfaces of the cooling water W on the central side of the cooling rolls 113 constitute free surfaces.

Then, as show in FIG. 10, the crucible 114 is located beside one of the cooling rolls 113, e.g., the cooling roll 113*a*, by use of the moving unit 116. Then, the molten alloy A is ejected from the nozzle 115 toward the outer circumferential surface of the cooling roll through the slit 117 so as to come in contact with the outer circumferential surface of the cooling roll 113*a*. In this way, the puddle P is formed between the slit 117 and the cooling roll 113*a*. Then, a portion of the molten alloy A forming the puddle P, which contacts the cooling roll 113*a*, is cooled down so as to increase viscosity and is drawn by the circumferential surface of the cooling roll 113*a* and cooled down by the cooling roll 113*a* while moving in the rotating direction of the cooling roll 113*a*, and is formed into a supercooled metallic fluid and then solidified and cooled down below the glass transition point to form the amorphous alloy foil strip S. The cooling rate at this time is equal to or above $1\times10^{5\circ}$ C./sec., for example.

The heat transmitted from the molten alloy A to the cooling roll 113*a* is transferred from the cooling roll 113*a* to the cooling water W through the inside of the roll. Then, the heat transmitted to the cooling water W is discharged to the outside of the cooling roll together with the cooling water W through the drain pipe 126. That is, the heat of the molten alloy A is discharged by way of the molten alloy A→the cooling roll 113*a*→the cooling water W.

The temperature of the cooling roll 113*a* is gradually increased along with casting of the foil strips S. When the temperature of the outer circumferential surface of the cooling roll reaches a predetermined value, the nozzle 115 is dosed to stop ejection of the molten alloy A. Next, the crucible 114 is moved along the rail of the moving unit 116 and is located beside the other cooling roll 113, i.e., the cooling roll 113B. Then, the nozzle 115 is opened to eject the molten alloy A toward the outer circumferential surface of the cooling roll 113*b*. In this way, the foil strip S is cast with the cooling roll 113*b* by the same operation as the above-described operation with the cooling roll 113*a*. Specifically, as shown in FIG. 4, the cooling roll used for casting the foil strips S is switched from the cooling roll 113*a* to the cooling roll 113*b*. Although the cooling roll 113*a* is in the standby state in this period, the cooling water W is continuously supplied to the cooling roll 113*a* as well to cool the cooling roll 113*a* down.

Thereafter, when the temperature of the cooling roll 113*b* reaches the predetermined value, the cooling roll used for casting the foil strips S is switched from the cooling roll 113*b* to the cooling roll 113*a*. By this time, the cooling roll is sufficiently cooled down so that it is possible to resume casting the foil strip S. Here, the cooling water W is continuously supplied to the cooling roll 113*b* in the standby state as well in this period to continue cooling. Likewise, as shown in FIG. 4, the cooling roll 113*a* and the cooling roll 113*b* are alternately used thereafter to continue production of the foil strips S.

A mechanism for cooling the cooling rolls used in the second embodiment is heat transmission by convection of the cooling water. As the cooling rolls 113 are rotated at the high speed, the strong centrifugal force is applied to the cooling water. The magnitude of this centrifugal force is 50 to 150 times as large as the gravity. For this reason, the temperature rises at a portion of the cooling water located close to the roll and large buoyancy acts on this portion where the density is reduced. This action forms a driving force to generate forcible convection. Accordingly, the cooling water has a sufficient heat transmitting effect although it remains almost stationary relative to the rolls.

Moreover, since the open roll is used as the cooling roll in this embodiment, no air bubbles remain on the inner surface of the cooling roll. The air bubbles come up and disappear on the free surface by the strong centrifugal force. In a method of feeding water through an embedded water channel, there may be a case in which quality of material of a formed foil strip is partially deteriorated by an influence of uneven cooling attributable to residual air. Configurations, operations, and effects of this embodiment other than those mentioned above are similar to the above-described first embodiment.

Figure 12A:
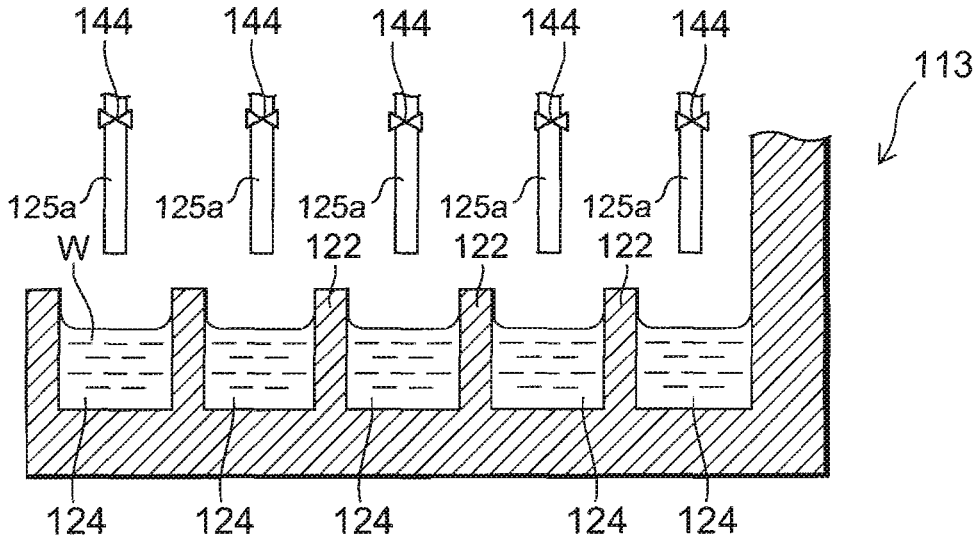

Next, a variation 1 of the second embodiment will be described. A cooling roll used in this variation 1 applies an open roll structure which is hollow inside and open on one of side surfaces. Moreover, the multiple water channels 124 extending in the circumferential direction of the cooling roll are formed by providing an inner circumferential surface with the partition plates 122. Further, as shown in FIG. 12A, each of the water channels 124 including a valve 144 is provided with the branch pipe 125*a* of the water supply pipe 125 and the branch pipe 126*a* of the drain pipe 126. In this way, it is possible to adjust a flow rate of the cooling water depending on the water channel 124, i.e., depending on the position in the width direction of the cooling roll 113, and to control a heat flow rate. Moreover, it is possible to set up a different water temperature depending on the water channel. By using this configuration, it is possible to equalize temperature distribution in the width direction of the cooling roll 113 and to equalize the cooling power in the width direction of the cooling roll.

Figure 12B:
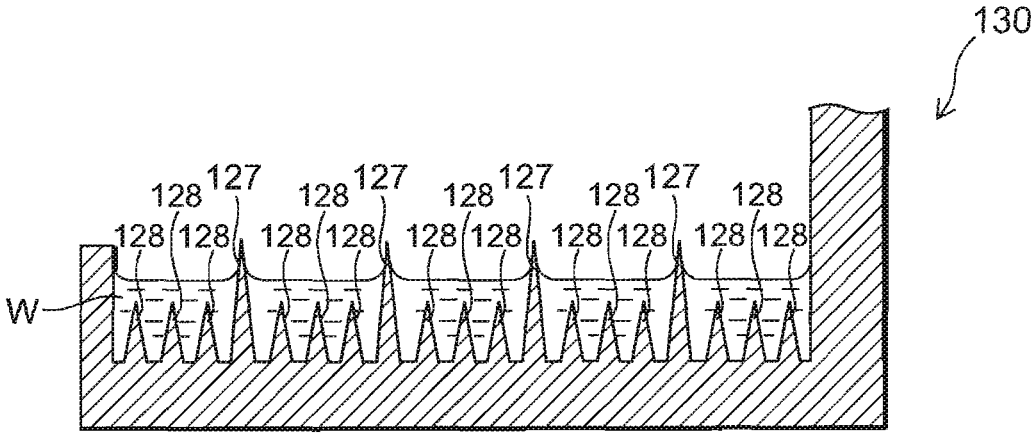

FIG. 12B shows a cross-section of another cooling roll 130 used in the variation 1. As shown in FIG. 12B, in the cooling roll 130, each water channel is provided with three fins 128, for example. Each of partition plates 127 and the fins 128 extends in the circumferential direction and a cross section orthogonal to the longitudinal direction is in a triangular shape. The heights of the fins are set lower than the heights of the partition plates so as to be submerged. It is possible to further enhance heat transfer efficiency by providing the fins 128.

Next, a variation 2 of the second embodiment will be described.

Figure 13:
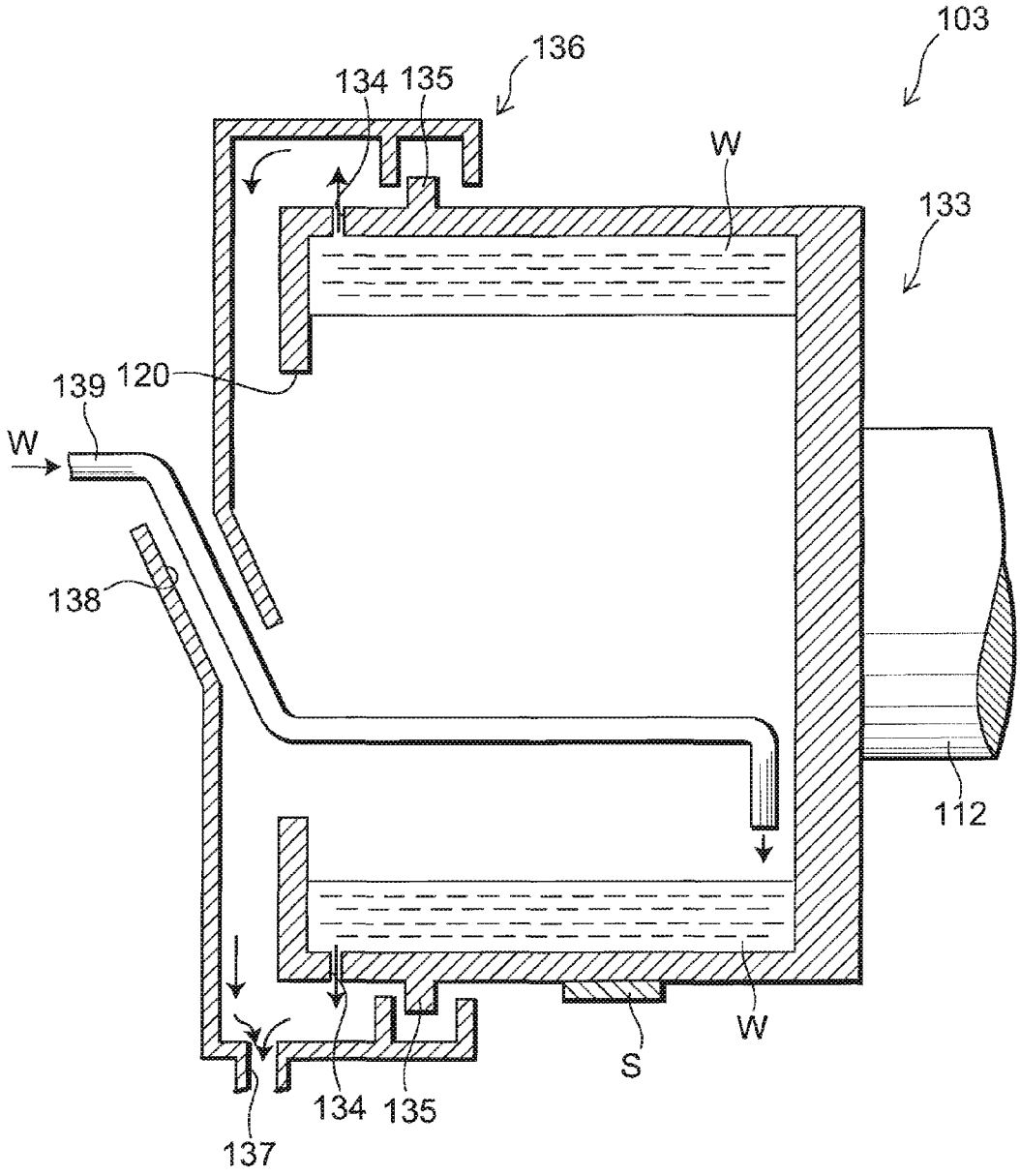
FIG. 13 is a cross-sectional view of the vicinity of a cooling roll in a production apparatus for an amorphous alloy foil strip according to a variation 2 of the second embodiment.

FIG. 13 is a cross-sectional view illustrating the vicinity of a cooling roll of a production apparatus 103 for an amorphous alloy foil strip according to this variation. As shown in FIG. 13, in the production apparatus 103 for an amorphous alloy foil strip according to this variation, a pair of cooling rolls 133 are provided on both sides of the driving unit 111 (see FIG. 10) as similar to the production apparatus 102 according to the above-described second embodiment.

Moreover, the drain pipe 126 (see FIG. 10) is not brought into the cooling roll 133 but through holes 134 to feed the cooling water from the water supply side toward the outer circumferential direction are formed at portions distant from the driving side of the cooling roll 133. Also, a convex portion 135 having a cross section of a convex shape is provided along the outer circumferential surface of the cooling roll at a portion closer to the driving side than the through holes 134. In addition, a flange 136 is provided so as to cover an end on the water supply side of the cooling roll 133, i.e., the portions where the through holes 134 and the convex portion 135 are provided. The flange 136 is not in contact with the cooling roll 133 but is fixed to a floor surface. A drain outlet 137 is provided at a bottom of the flange 136.

Furthermore, an entrance port is provided on a side surface of the flange 136 and a water supply pipe 139 is brought into the cooling roll 133 through this entrance portion 138 and the opening 120. The water supply pipe 139 is not provided with any branch pipes and is configured to supply the cooling water W to a portion on the driving side in the cooling roll 133. Moreover, no partition walls 122 (see FIG. 11) are formed in the inner circumferential surface of the cooling roll 133. Configurations of this variation other than those mentioned above are similar to the production apparatus 102 (see FIG. 10) according to the above-described second embodiment.

Next, operations of the production apparatus 103 according to this variation will be described.

In this variation, the cooling water W supplied into the cooling roll 133 via the water supply pipe 125 sticks to the inner circumferential surface of the cooling roll 133 by the centrifugal force and moves from the driving side to the water supply side along an axial direction of the cooling roll 133 while being rotated in the circumferential direction of the cooling roll 133 together with rotation of the cooling roll 133. In this process, heat exchange with the cooling roll 133 takes place. Then, the cooling water W is discharged out of the cooling roll 133 via the through holes 134 by the centrifugal force. The cooling water W discharged from the through holes 134 is received by the flange 136 and collected at a lower part of the flange 136 by way of the gravity, and is discharged via the drain outlet 137. Operations of this variation other than those mentioned above are similar to the above-described second embodiment. That is, the foil strips S are cast by alternately using the pair of cooling rolls 133.

Next, effects of this variation will be described.

In this variation, it is not necessary to insert the drain pipe into the cooling water W which is rotated at the high speed inside the cooling rollers 133. Therefore, vibration and the like attributable to resistance of the water hardly occurs and mechanical reliability is high. Moreover, the water flow of the cooling water W is stabilized. Effects of this variation other than those mentioned above are similar to the above-described second embodiment.

Here, it is also possible to provide fins inside the cooling roll 133 in order to increase a contact area with the cooling water W. In this case, notches are formed on the fins in order to render the cooling water W movable along the axial direction of the cooling roll 133. In this way, it is easy to discharge the cooling water W which is warmed up.

Next, a third embodiment of the invention will be described.

Figure 14:
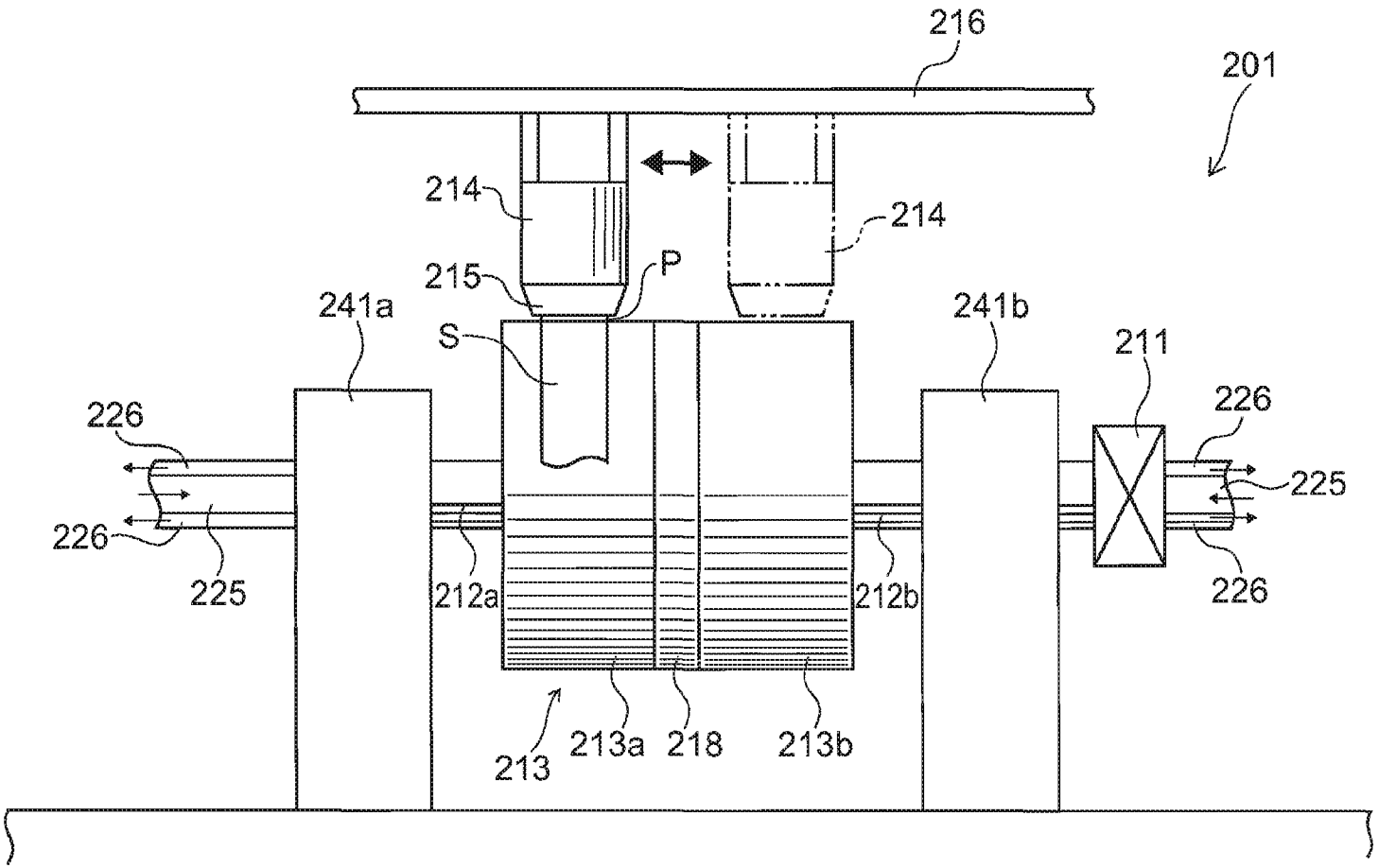
FIG. 14 is a front view illustrating a production apparatus for an amorphous alloy foil strip according to a third embodiment of the invention.
Figure 15:
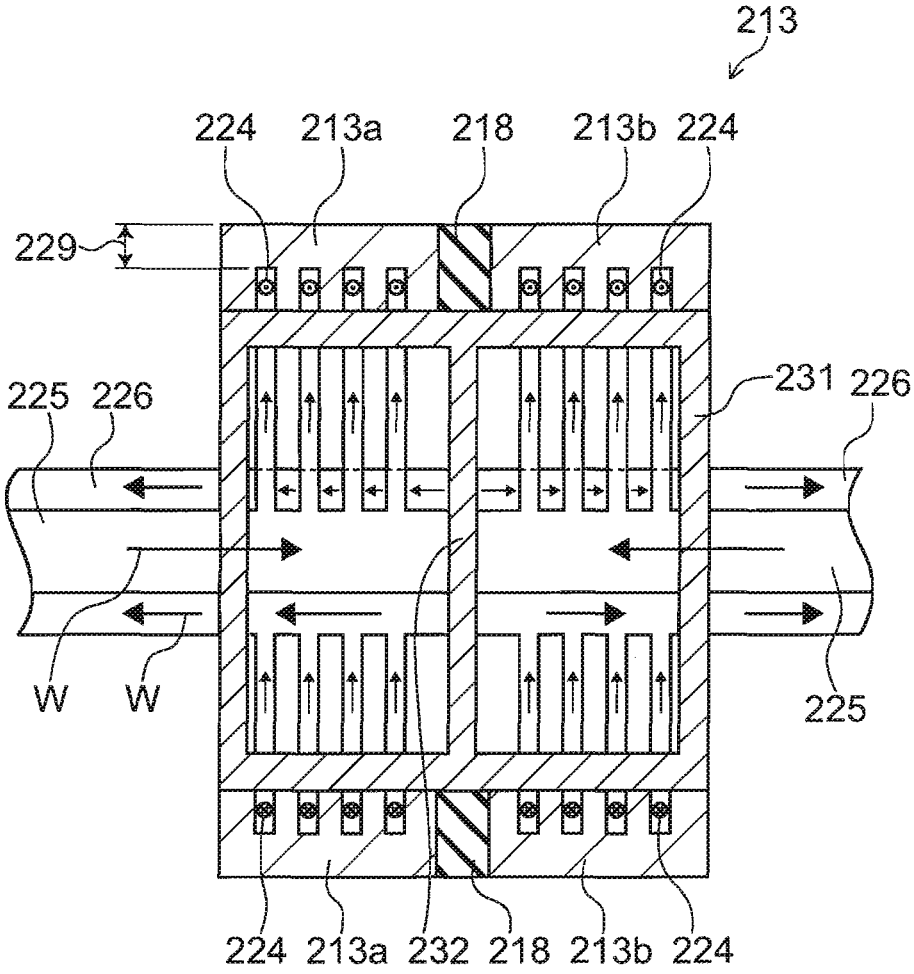
FIG. 15 is a cross-sectional view illustrating the structure of a cooling roll of FIG. 14.
Figure 16:
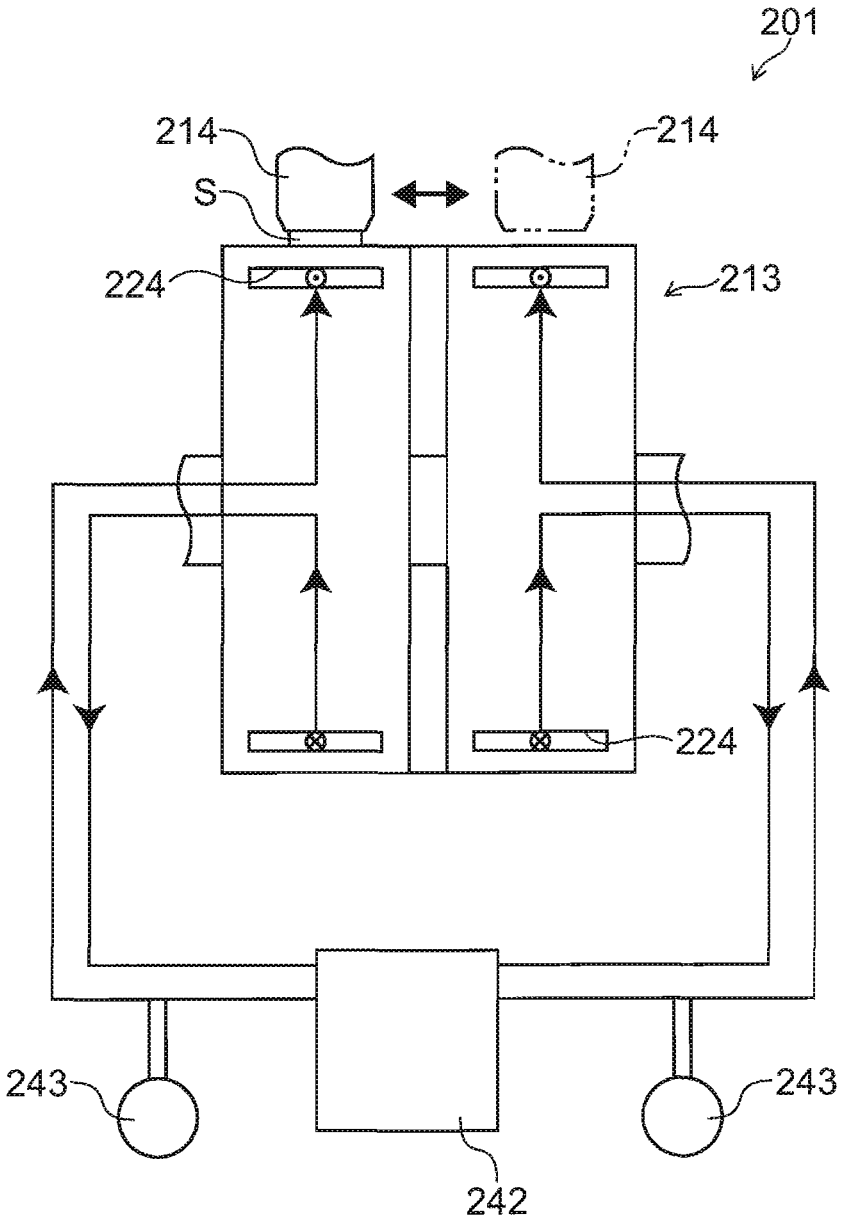
FIG. 16 is a conceptual diagram illustrating a pathway of cooling water to cool the cooling roll in FIG. 14.
Figure 17:
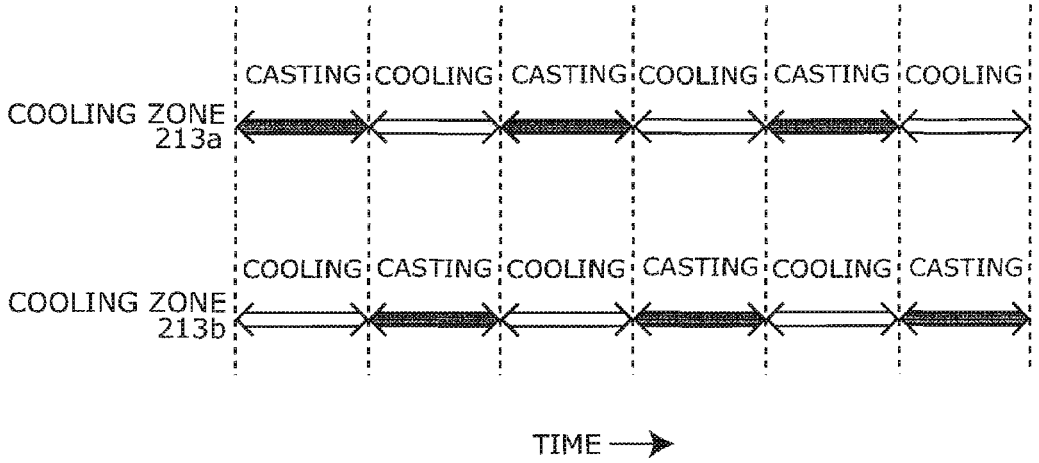
FIG. 17 is a timing chart illustrating a method for producing an amorphous alloy foil strip according to the embodiment, in which a horizontal axis indicates time and a vertical axis indicates cooling zones.
Figure 18:
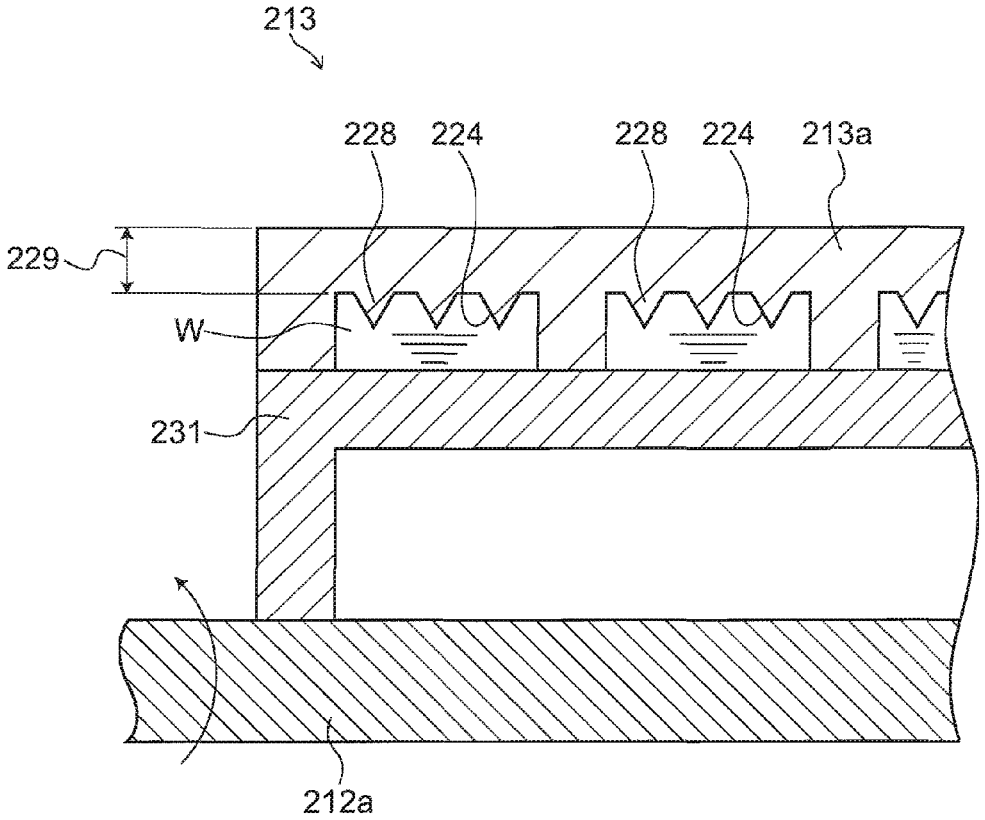
FIG. 18 is a cross-sectional view of a water channel illustrating a fin provided in the inner surface in contact with cooling water of a cooling zone.

FIG. 14 is a front view illustrating a production apparatus for an amorphous alloy foil strip according to this embodiment. FIG. 15 is a cross-sectional view illustrating the structures of a cooling roll and cooling zones in FIG. 14. FIG. 16 is a conceptual diagram showing a pathway of cooling water circulated in the cooling roll in FIG. 14. FIG. 17 is a tinning chart illustrating a method for producing an amorphous alloy foil strip according to this embodiment in which a horizontal axis indicates time and a vertical axis indicates the cooling zones.

As shown in FIG. 14, a production apparatus 201 for an amorphous alloy foil strip according to this embodiment is configured to mainly produce the iron-base amorphous alloy foil strip S as similar to the first embodiment. Compositions of the foil body S to be produced in this embodiment are similar to the above-described first embodiment, which are the compositions shown in FIG. 5, for example.

A cooling roll 213 having a large wall thickness configured to circulate cooling water inside is disposed in the production apparatus 201. The cooling roll 213 is rotatably supported by rotating shaft members 212*a* and 212*b* (hereinafter also collectively referred to as "rotating shaft members 212"), and the rotating shaft members 212 are connected to a driving unit 211 which shares a common rotating axis. A motor (not shown) is embedded in the driving unit 211 and is configured to rotate the cooling roll via the rotating shaft members 212. The rotating shaft members 212 and the cooling roll 213 are supported by bearings 241*a* and 241*b*.

As shown in FIG. 14 and FIG. 15, two cooling zones 213*a* and 213*b*, which have a heat insulating zone 218 interposed therebetween, are provided in an outer circumferential portion of the cooling roll 213. The cooling zones 213*a* and 213*b* are fixed to a supporting mechanism 231 made of a metallic alloy having large strength. The shape of the cooling zones 213*a* and 213*b* is a ring shape surrounding the outer circumferential portion of the cooling roll 213 and having a predetermined thickness, which are separated from each other in an axial direction of the cooling roll 213. Also, the heat insulating zone 218 is disposed between the cooling zone 213*a* and the cooling zone 213*b*, and the thickness thereof is set equal to or above 50% of the respective thicknesses of the cooling zones 213*a* and 213*b*. For example, the outer circumferential surfaces of the cool zone 213*a* and 213*b* and of the heat insulating zone 218 form a continuous surface. The supporting mechanism 231 is coupled with the roll driving unit 211, whereby the cooling roll 213 is provided with a torque by the roll driving unit 211.

The cooling zones 213*a* and 213*b* are made of metal or an alloy having high thermal conductivity, and are made of copper or a copper alloy, for example. The thermal conductivity of copper is equal to 395 W/(m·K) at 100° C. Alternatively, the cooling zones 213*a* and 213*b* may be made of either a Be—Cu alloy or a Cr—Cu alloy, and the thermal conductivity of these copper alloys ranges from 150 to 300 W/(m·K).

On the other hand, the heat insulating zone 218 is made of a material having lower thermal conductivity than the material for forming the cooling zones 213*a* and 213*b*, and is made of a material having the thermal conductivity equal to or below 3 W/(m·K), for example. The heat insulating zone 218 is made of, for example, a refractory brick (thermal conductivity: 1.1 W/(m·K)), a porcelain (thermal conductivity: 1.5 W/(m·K)), glass (thermal conductivity: 1.4 W/(m·K)), or asbestos (thermal conductivity: 0.3 W/(m·K)).

The production apparatus 201 is provided with a crucible 214 for retaining the molten alloy A (see FIG. 3), and a nozzle 215 for ejecting the molten alloy A in the crucible 214 to the outside of the crucible 214 is fitted to a lower end of the crucible 214. Here, an ejection portion of the nozzle 215 is disposed closely to the outer circumferential surface of the cooling roll 213. Configurations of the crucible 214 and the nozzle 215 are similar to the configurations of the crucible 114 and the nozzle 215 (see FIG. 2) in the above-described first embodiment. The nozzle 215 is a multiple-slit nozzle, for example.

Further, the production apparatus 201 is provided with a moving unit 216 for moving the crucible 214 along the axial direction of the cooling roll 213. The moving unit 216 moves the crucible 214 between a position where the nozzle 215 faces the cooling zone 213*a* and a position where the nozzle 215 faces the cooling zone 213*b*.

FIG. 16 shows a simplified pathway of cooling water W in the production apparatus for an amorphous alloy foil strip according to this embodiment. In the production apparatus 201, in order to retain the cooling water lower than a predetermined temperature such as a room temperature during casting, cooling units 243 configured to cool the cooling water down are provided in the course of the pathway of the cooling water W, e.g., in a water tank 242. The cooling water is supplied from the water tank 242 to water channels 224 of the cooling roll 213 by use of water supply pipes 225, and after circulation in the cooling roll 213, is returned from the water channels 224 to the water tank 242 via drain pipes 226. Then, the cooling water is cooled down by the cooling units 243 in the course of the circulation. Here, no water channel 224 is formed inside the heat insulating zone 218.

Configurations of the water supply pipes 225 and the drain pipes 226 are not limited to the configurations shown in FIG. 15. It is possible to apply any configurations connectable to the cooling roll 213. For example, as shown in FIG. 15, the water supply pipe 225 and the drain pipe 226 may constitute a double pipe. In this case, the cooling zone 213*a* and the cooling zone 213*b* are respectively provided with a cooling water circulation system, which includes the water tank 242, the cooling unit 243, the water supply pipe 225, the water channel 224, and the drain pipe 226, independently of each other. This is intended for thermally separating the cooling zone 213*a* from the cooling zone 213*b*. Alternatively, it is also possible to connect the water supply pipe 225 to one end of the cooling roll 213 in the axial direction and to connect the drain pipe 226 to the other end. In this case, the water supply pipe 225 pierces a central part 232 of the supporting mechanism 231 of the cooling roll 213 in the axial direction. Moreover, as viewed from the axial direction of the cooling roll 213, the water channels on a water supply side are branched off from the center toward the outer circumferential surface of the cooling roll 213 in two mutually opposite directions and the water channels on a drain side are merged from two directions which are orthogonal to a direction of extension of the branches on the water supply side from the outer circumferential surface toward the center of the cooling roll 213. That is, as viewed from the axial direction of the cooling roll

213, the branches connecting the central part to an outer circumferential portion of the cooling roll 213 is formed into a cruciform.

Next, operations of the production apparatus 201 according to this embodiment configured as described above, that is, a method for producing an amorphous alloy foil strip according to this embodiment will be described.

First, as shown in FIG. 14, the cooling roll 213 is rotated by way of the rotating shaft members 212 by driving the driving unit 211. Next, the nozzle 215 is located closely to the outer circumferential surface of one of the cooling zones on the cooling roll 213, e.g., the cooling zone 213*a*, while providing a given interval. Then, the molten alloy A is ejected from the crucible 214 via the nozzle 215. In this way, a puddle P is formed between the nozzle 215 and the cooling zone 213*a*. Then, of the molten alloy forming the puddle P, the molten alloy located in the vicinity of a contact surface with the cooling zone 213*a* is cooled down so as to increase viscosity and is drawn out of the puddle P by rotation of the cooling roll 213. The alloy thus drawn out is a supercooled liquid at this point, but is quenched by the cooling roll 213 down to a glass transition temperature or below and is formed into the amorphous alloy foil strip S. A cooling rate required for rendering the foil strip (or the supercooled liquid) drawn out of the puddle P amorphous is equal to or above $1\times10^{5}$° C./sec. in the case of the iron-base alloy, for example.

The heat transmitted from the molten alloy and the foil strip to the cooling zone 213*a* in order to form the amorphous alloy foil strip is transferred from the outer circumferential portion of the cooling zone 213*a* into the cooling roll 213 and transmitted to the cooling water circulated inside the water channel 224. Then, the heat transmitted to the cooling water is collected by the water tank 242 together with the cooling water via the drain pipe 226. That is, the heat of the molten alloy A is discharged by way of the molten alloy A→the cooling roll 213→the cooling water W.

Thereafter, when the temperature of the cooling zone 213*a* reaches a predetermined value (Th) along with casting of the foil strip S, the nozzle 215 is closed to stop ejection of the molten alloy A. After the stop, the moving unit 216 promptly moves the crucible 214 close to the outer circumferential surface of the cooling zone 213*b*. Then, the supply of the molten alloy A is resumed. In this way, a foil strip S is cast by using the cooling zone 213*b*. At this time, the cooling zone 213*b* is gradually heated along with casting of the foil strips S, the cooling zone 213*a* is rapidly cooled down by the cooling water. Thereafter, when the temperature of the cooling zone 213*b* reaches the predetermined value (Th), the supply of the molten alloy A is stopped and the crucible 214 is promptly moved close to the outer circumferential surface of the cooling zone 213*a* again. Then, the molten alloy is supplied. By this time, the cooling zone 213*a* is sufficiently cooled down and reaches the room temperature, for example. When the temperature of the cooling zone 213*a* exceeds the predetermined value (Th) again, the supply of the molten alloy A is stopped and the crucible 214 is promptly moved to the position corresponding to the cooling zone 213*b* to continue casting. By alternating the above-described actions, it is possible to ensure the cooling rate necessary for forming the amorphous body. This is particularly effective for production of foil strips having a large sheet thickness (equal to or above 30 μm). In contrast, it has not been possible to perform continuous casting for a long period of time to form thick foil strips equal to or above 30 μm because the cooling roll having a single cooling zone has been used previously.

Although the above-described example has exemplified the aspect of moving the crucible 214 from the position facing the cooling zone 213*a* to the position facing the cooling zone 213*b*, it is also possible to move the cooling zone to face the nozzle 215 from the cooling zone 213*a* to the cooling zone 213*b* by moving the cooling roll 213 along the rotating axis thereof.

Accordingly, by repeating a first process of supplying the molten alloy A to the outer circumferential surface of the cooling zone 213*a* while rotating the cooling roll 213 and a second process of stopping the supply of the molten alloy A, moving the crucible 214 to the position facing the outer circumferential surface of the cooling zone 213*b*, and supplying the molten metal A to the outer circumferential surface of the cooling zone 213*b*, it is possible to produce the amorphous alloy foil strip having a large sheet thickness almost continuously in an industrial scale. An operation style in this embodiment is illustrated in FIG. 17. As shown in FIG. 17, when casting is performed by using one of the cooling zones, the other cooling zone is in a cooling process by using the cooling water.

Next, the production apparatus and the production method according to this embodiment will be described in detail.

Heat capacities of the cooling zones 213*a* and 213*b* of the cooling roll 213 are designed based on the heat transfer mechanism explained in conjunction with the above-described first embodiment. It is effective to increase the heat capacities of the cooling zones 213*a* and 213*b* in order to extend the time to the start of crystallization and the time to the interruption of pouring in FIG. 8. This means nothing but increasing the wall thickness, the diameter, and the width of the cooling zones.

Each of the cooling zones 213*a* and 213*b* preferably has a wall thickness equal to or above 25 mm. The reason for this is similar to the reason for setting the wall thickness 129 (see FIGS. 6A to 6C) of the cooling roll 113 equal to or above 25 mm in the above-described first embodiment. Also, the diameter of the cooling zones 213*a* and 213*b* is set preferably in a range from 0.4 to 2.0 m. It is possible to ensure sufficient time within one round of the cooling zone by setting the diameter of the cooling zones 213*a* and 213*b* equal to or above 0.4 m. As a result, the heat transmitted from the molten alloy to the outer circumferential surface of the cooling zone is efficiently discharged to the cooling water. On the other hand, by setting the diameter of the cooling zones equal to or below 2.0 m, it is possible to facilitate an operation while avoiding an excessive increase in size of the production apparatus 201. Moreover, it is possible to facilitate ensuring strength of mechanical portions such as the bearings of the cooling roll 213.

Also, it is preferable to set the width of each of the cooling zones 213*a* and 213*b* equal to 1.5 times or more of the width of the foil strip S, which is intended to be produced. In this way, the heat transmitted from the molten alloy A to the cooling zones 213*a* and 213*b* is also spread in the width direction and the amount of heat discharged to the cooling water for each round of the cooling roll is increased.

Further, the material of the cooling zones 213*a* and 213*b* preferably has a large thermal conductivity. For example, the material has the thermal conductivity preferably equal to or above 250 W/(m·K) and more preferably equal to or above 300 W/(m·K). The uneven thermal deformation of the roll, which has been the problem of the conventional thin wall roll, hardly occurs by increasing the wall thickness of the cooling zones 213*a* and 213*b*. Accordingly, it is possible to select the material while placing more emphasis on the thermal conductivity than the mechanical strength. However, the material having the large thermal conductivity tends to have poor abrasion resistance. It is possible to achieve both the abrasion resistance and the high thermal conductivity by carrying out the process to harden only the surface layer of the circumferential portion of the cooling roll in order to retain the abrasion resistance. Hardening of the surface layer can be achieved by ion implantation, for example. In this case, it is preferable to provide implanted ions with a concentration gradient in order to prevent occurrence of a crack attributable to a heat stress.

On the other hand, the reason for providing the heat insulating zone 218 is to reduce the amount of heat flowing to the adjacent cooling zone. A temperature gradient in the width direction of the cooling zone occurs if this amount of heat is significant, and this may cause deviation of the sheet thickness in the width direction of the foil strip. Therefore, it is preferable to increase the wall thickness (a depth) of the heat insulating zone 218 as much as possible. The wall thickness of the heat insulating zone 218 is preferably equal to or above 50% of the wall thickness of the cooling zones, and is more preferably equal to the wall thickness of the cooling zones. While the width of the heat insulating zone 218 depends on the thermal conductivity of the heat insulating zone, it is adequate to provide about 1 mm in the case of a refractory or a ceramic. In view of productivity, the width should be designed so as to render a time loss attributable to the nozzle movement as little as possible.

The material of the heat insulating zone 218 is not particularly limited as long as the material has heat resistance and low thermal conductivity. Refractory and ceramics such as BN or $Al_2O_3$ are cited as examples. It is also possible to use only the air as the heat insulating zone 218 without using any specific material. In other words, it is possible to form the heat insulating zone 218 by using an air layer. The thermal conductivity of the air is equal to 0.03 W/(m·K). Accordingly, it is possible to achieve extremely high heat insulation. However, the molten alloy may be spilled on a groove between the cooling zones when moving the nozzle from one of the cooling zones to the other cooling zone. It is therefore preferable to cover the groove with a material having poor wettability to the molten alloy in order to avoid such a problem and not to cause a coagulation to adhere to the groove.

Here, it is also preferable to provide fins 228 in the inner surfaces of the water channels 224 as shown in FIG. 10 in order to further enhance the cooling effect of the cooling water W. By increasing the contact area between the cooling zone and the cooling water, it is possible to increase the amount of heat discharged of the cooling water W and to extend the time to the change of casting.

When starting the supply (pouring) of the molten alloy A onto the outer circumferential surface of one of the cooling zones, e.g., the cooling zone 213*a*, via the nozzle 215, the temperature of the outer circumferential surface of the cooling zone 213*a* is rapidly increased immediately after the start of pouring. Then, the rate of rise is reduced and the temperature is gently increased at a constant rate thereafter. Even if the temperature of the outer circumferential surface of the cooling zone 213*a* is increased, the sheet thickness of the foil strip remains almost constant as long as the temperature is equal to or below 200° C., for example, thereby ensuring the cooling rate necessary for forming the amorphous body. That is, the amorphous alloy foil strip is obtained. Here, the measurement of the temperature of the outer circumferential surface of the cooling zone is performed in a position in the center of the width of the cooling zone and located 20 cm away on the upstream side from the puddle P, for example. A contact-type thermometer is used for measuring the temperature of the outer circumferential surface of the cooling roll, for example. The concrete example is disclosed in Patent Document 3.

The timing to change casting between the cooling zones may also be determined by measuring the surface temperature of the formed foil strip S. A position of measurement is preferably located in an appropriate position prior to detachment of foil strip S from the cooling roll. Although the contact-type thermometer can be used as the thermometer for measuring the surface temperature of the foil strip S, it is also possible to use the infrared radiation thermometer in the case of the iron-base alloy. Monitoring the temperature of the foil strip S is a more straightforward measure for judging the amorphous property of the foil strip in the course of casting. It is also possible to employ a method of monitoring the temperature in a predetermined position on the outer circumferential surface of the cooling zone. In the case of the same apparatus, it is also possible to set up time for the casting change based on the casting time with which the fine foil strip can be obtained. If the size (the sheet thickness and the width), the alloy composition, and the like of the amorphous alloy foil strip to be produced remain the same, it is also possible to perform the change based on time which is measured in advance.

Next, effects of this embodiment will be described.

In this embodiment, the cooling roll 213 of the production apparatus 201 for an amorphous alloy foil strip is provided with the two cooling zones 213*a* and 213*b* and the foil strips S are cast by alternately using these zones. In this way, the single cooling zone repeats casting and cooling down, whereby it is possible to set the roll temperature equal to or below the predetermined value. As a result, it is possible to produce the amorphous alloy foil strip having a large sheet thickness in an industrial scale. The amorphous alloy foil strip is applicable to a power transformer or a core of a motor, for example, and is also applicable to a magnetic shield material.

Moreover, in this embodiment, the cooling zone 213*a* and the cooling zone 213*b* are disposed distant from each other. Therefore, the cooling zones are thermally independent so that one of the cooling zones can be cooled down while the foil strips are cast in the other cooling zone. In addition, by providing the heat insulating zone 218 between the cooling zone 213*a* and the cooling zone 213*b*, it is possible to enhance rigidity of the entire cooling roll 213 while maintaining the heat insulation between the cooling zone 213*a* and the cooling zone 213*b*.

Furthermore, according to this embodiment, it is possible to perform casting alternately by using the single cooling roll. Therefore, as compared to the above-described first and second embodiments, there is an advantage that it is only necessary to provide one set of the driving unit and the like. In this way, equipment costs can be suppressed. On the other hand, since the two cooling rolls are provided according to the first and second embodiments, it is possible to thermally separate the cooling rolls more reliably and to rotate the cooling rolls at mutually different rotating speeds. Accordingly, there is an advantage of increase in the degree of freedom of production.

Configurations, operations, and effects of this embodiment other than those mentioned above are similar to the above-described first embodiment. For example, since the multiple-silt nozzle is also used as the nozzle 215 in this embodiment, it is possible to equalize the sheet thickness of the foil strips S and to reduce occurrence of pin holes. For example, it is possible to control the number density of pin holes on the foil strip S equal to or below 25 holes/$m^2$, for example, or equal to or below 10 holes/$m^2$, for example, or none, for example. Moreover, since this embodiment also applies the cooling zones having a large wall thickness, it is possible to resolve various problems attributable to the uneven thermal deformation of the cooling roll, which may occur frequently in the case of using the thin wall roll. For example, local embrittlement or fluctuation in magnetic characteristics of the foil strips S due to uneven cooling of the foil strips or the like does not occur.

Next, a fourth embodiment of the invention will be described.

Figure 19:
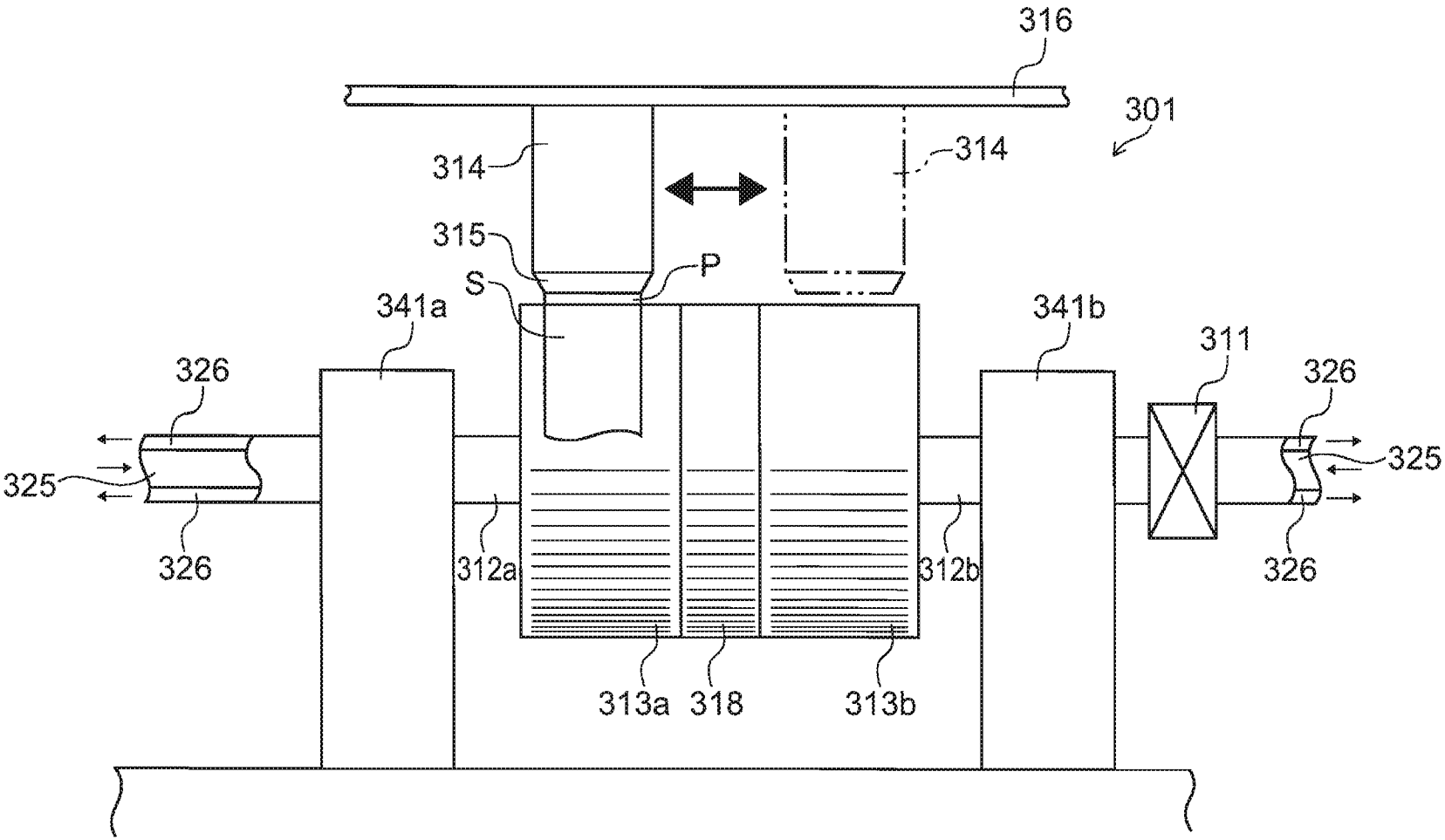
FIG. 19 is a front view illustrating a production apparatus for an amorphous alloy foil strip according to a fourth embodiment of the invention.
Figure 20:
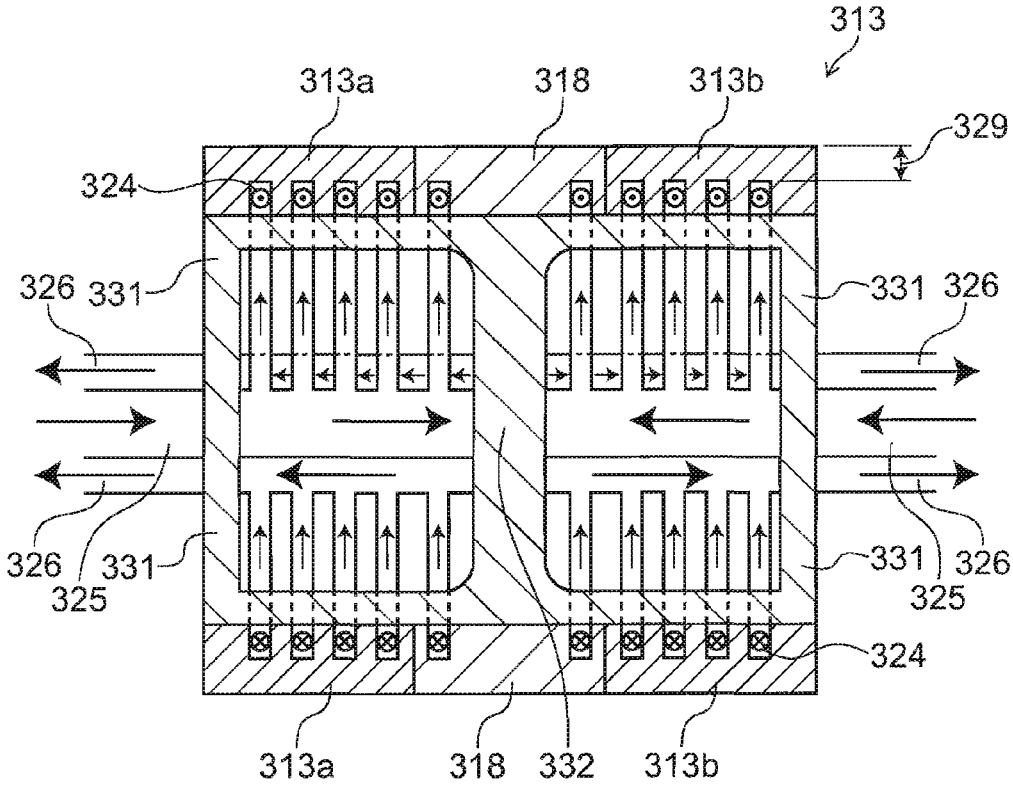
FIG. 20 is a cross-sectional view illustrating the structure of a cooling roll of FIG. 19.
Figure 21:
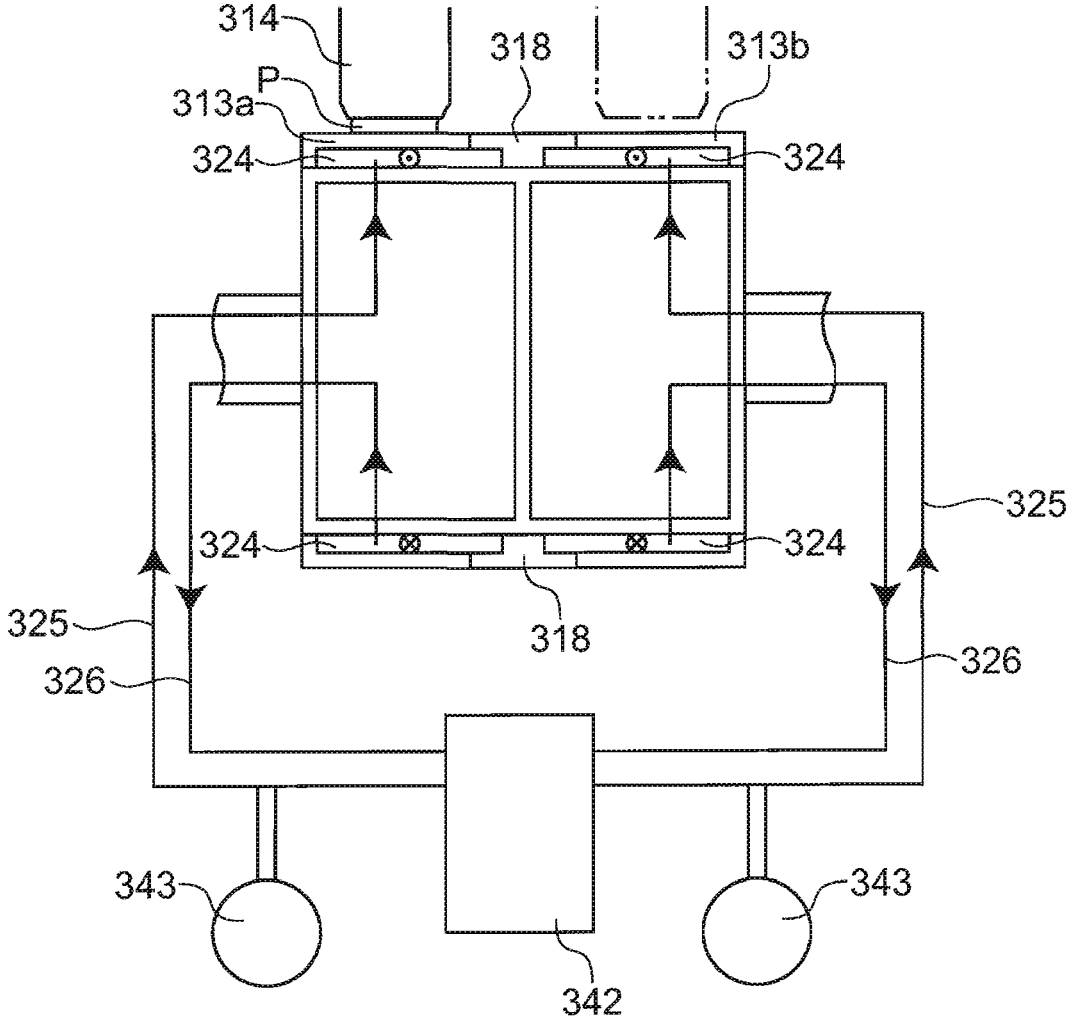
FIG. 21 is a conceptual diagram illustrating a pathway of cooling water circulated in the cooling roll in FIG. 19.

FIG. 19 is a front view illustrating a production apparatus for an amorphous alloy foil strip according to this embodiment. FIG. 20 is a cross-sectional view illustrating the structures of a cooling roll and cooling zones in FIG. 19. FIG. 21 is a conceptual diagram showing a pathway of cooling water circulated in the cooling roll in FIG. 19.

As shown in FIG. 19, a production apparatus 301 for an amorphous alloy foil strip according to this embodiment is configured to mainly produce an iron-base amorphous alloy foil strip S. The compositions, the sheet thickness, and the width of the foil strip S are similar to the above-described first to third embodiments.

As shown in FIG. 19 and FIG. 20, a cooling roll 313 having a large wall thickness configured to circulate cooling water inside is disposed in the production apparatus 301. Two cooling zones 313*a* and 313*b*, which have a forbidden zone 318 interposed therebetween, are provided at an outer circumferential portion of the cooling roll 313. The cooling zones 313*a* and 313*b* are fixed to a supporting mechanism 331 made of a metallic alloy having large strength. The forbidden zone 318 is a portion in the outer circumferential surface of the cooling roll 313 where no molten alloy is supplied.

The cooling zones 313*a* and 313*b* are made of metal or an alloy having high thermal conductivity, and are made of, for example, copper or a copper alloy. The thermal conductivity of copper is equal to 395 W/(m·K) at 100° C. Alternatively, the cooling zones 313*a* and 313*b* may be made of either the Be—Cu alloy or the Cr—Cu alloy, and the thermal conductivity of these copper alloys ranges from 150 to 300 W/(m·K).

On the other hand, the forbidden zone 318 may be formed integrally with the cooling zones 313*a* and 313*b* by use of the same material or may be made of a different material from the cooling zones 313*a* and 313*b*. For example, when the forbidden zone 318 is made of a different material from the cooling zones 313*a* and 313*b*, thermal conductivity of such a material is set, for example, equal to or above 10 W/(m·K). For example, carbon steel (thermal conductivity: 48.5 W/(m·K)), 18-8 stainless steel (thermal conductivity: 16.5 W/(m·K)), and a copper alloy such as brass (thermal conductivity: 128 W/(m·K)) may be cited as the material for forming the forbidden zone 318.

FIG. 21 shows a simplified pathway of cooling water W in the production apparatus for an amorphous alloy foil strip according to this embodiment. Water channels 324 are formed inside the cooling roll 313. The water channels 324 are also formed inside the forbidden zone 318 in addition to the inside of the cooling zones 313*a* and 313*b*.

Configurations of this embodiment other than those mentioned above are similar to the above-described third embodiment. Specifically, the production apparatus 301 is provided with a moving unit 316 for moving a crucible 314 along the axial direction of the cooling roll 313. The moving unit 316 moves the crucible 314 between a position where a nozzle 315 faces the cooling zone 313*a* and a position where the nozzle 315 faces the cooling zone 313*b*. Moreover configurations of the water channels 324, water supply pipes 325 and drain pipes 326 may also apply various configurations as similar to the above-described third embodiment. In addition, the nozzle 315 is a multiple-slit nozzle, for example.

Next, operations of the production apparatus 301 according to this embodiment configured as described above, that is, a method for producing an amorphous alloy foil strip according to this embodiment will be described.

In this embodiment as well, the molten alloy A is supplied to the cooling zone 313*a* and the cooling zone 313*b* alternately by moving the crucible 314 by use of the moving unit 316, as in the case of the above-mentioned third embodiment. At this time, the molten alloy A is not supplied to the forbidden zone 318. In this way, it is possible to circulate the cooling water to cool one of the cooling zones down while producing the foil strip S in the other cooling zone, and thereby to produce the foil strip S having a large sheet thickness almost continuously in an industrial scale.

Moreover, in this embodiment as well, it is preferable to set the width of each of the cooling zones 313*a* and 313*b* equal to 1.5 times or more of the width of the foil strip S, which is intended to be produced, as in the case of the above-mentioned third embodiment. In this way, the heat transmitted from the molten alloy A to the cooling zones 313*a* and 313*b* is also spread in the width direction and the amount of heat discharged to the cooling water for each round of the cooling roll is increased.

On the other hand, the forbidden zone 318 interposed between the cooling zones is provided in order to equalize temperature distribution in the width direction inside the cooling zones caused by alternate casting by suppressing the heat transfer between the cooling zones, and thereby to minimize an influence on the formed amorphous foil strip. It is preferable that the material of the forbidden zone 318 have lower thermal conductivity than the material of the cooling zones. However, the same thermal conductivity is also acceptable. If the material of the forbidden zone 318 is the same as the material of the cooling zones, the forbidden zone 318 means a thick wall portion of the cooling roll interposed between the two cooling zones where the outer circumferential surface of the cooling zone does not contact the molten alloy.

Figure 22:
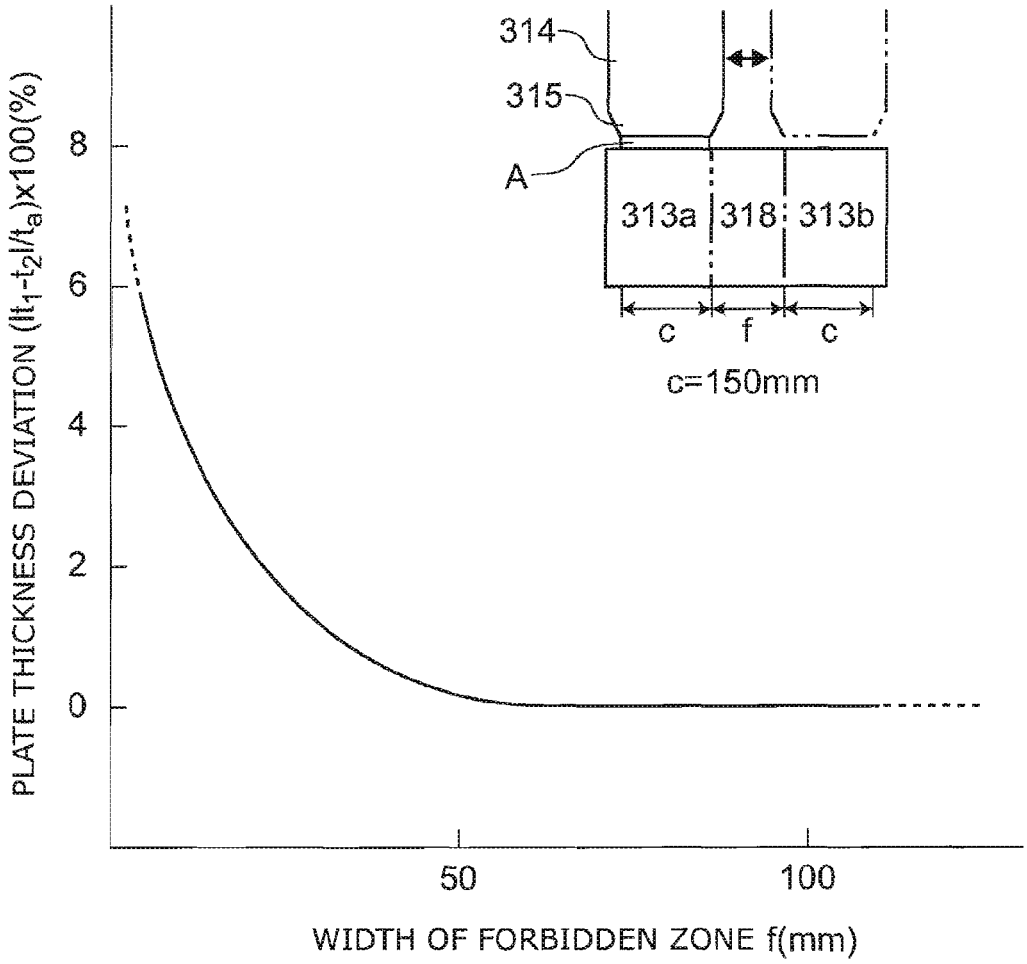
FIG. 22 is a graph illustrating influences of the width of a forbidden zone on the sheet thickness deviation of an amorphous foil strip.

When the thermal conductivity of the forbidden zone 318 is equivalent to the thermal conductivity of the cooling zones, it is preferable to set the width of the forbidden zone 318 as large as possible. In the case of the same thermal conductivity, it is preferable to set the width of the forbidden zone 318 at least equal to or above ⅓ of the width of the amorphous alloy foil strip S. As shown in FIG. 22, if the width f of the forbidden zone falls below ⅓ of the width c of the foil strip S, the sheet thickness of the formed amorphous alloy foil strip is inclined in the width direction. Here, in FIG. 22, sheet thickness deviation is percentage of a difference $|t_1-t_2|$ between sheet thicknesses $t_1$ and $t_2$ on both width ends of the foil strip relative to an average $t_a$ of the sheet thicknesses in the width direction. Moreover, FIG. 22 shows a case where the width c of the foil strip is equal to 150 mm, in which the sheet thickness deviation is suddenly increased if the width f of the forbidden zone becomes equal to or below 50 mm, i.e., equal to or below ⅓ of the width c of the foil strip. Here, measurement of the sheet thicknesses is carried out by use of a micrometer, which represents an average of values measured in regions near both of width ends of the foil strip each having an area of 1 $cm^2$. Occurrence of the sheet thickness deviation on the foil strip is not favorable because problems such as reduction in the space factor of a core or winding failures in a core winding process are caused.

Next, effects of this embodiment will be described.

In this embodiment, the cooling roll 313 of the production apparatus 301 for an amorphous alloy foil strip is provided with the two cooling zones 313*a* and 313*b* and the foil strips S are cast by alternately using these zones. In this way, the single cooling zone repeats casting and cooling down, whereby it is possible to set the roll temperature equal to or below the predetermined value. As a result, it is possible to produce the amorphous alloy foil strip having a large sheet thickness in an industrial scale. The amorphous alloy foil strip is applicable to a power transformer or a core of a motor, for example, and is also applicable to a magnetic shield material.

Moreover, in this embodiment, the cooling zone 313*a* and the cooling zone 313*b* are disposed distant from each other, and the forbidden zone 318 having the predetermined width is interposed between the cooling zones, and no molten alloy is supplied to the forbidden zone 318. Accordingly, it is possible to render the cooling zones thermally independent of each other. In this way, it is possible to produce the thick foil strips at high productivity while ensuring the cooling rate, to suppress inclination of the temperature of one of the cooling zones in the width direction due to presence of the other cooling zone, and thereby to prevent the foil strips from causing the sheet thickness deviation.

Operations and effects of this embodiment other than those mentioned above are similar to the above-described third embodiment. For example, since the multiple-silt nozzle is also used as the nozzle 315 in this embodiment, it is possible to equalize the sheet thickness of the foil strips S and to reduce occurrence of pin holes. Moreover, since this embodiment also employs the cooling zones having a large wall thickness, it is possible to eliminate various problems attributable to the uneven thermal deformation of the roll, which may occur frequently in the case of using the conventional thin wall roll. For example, local embrittlement or fluctuation in magnetic characteristics of the foil strips S due to uneven cooling of the foil strips or the like does not occur.

Hereinabove, the invention is described with reference to embodiments and variations. However, the invention is not limited to these embodiments and variations. For example, the invention also encompasses addition, deletion or design changes of constituents, or addition, deletion or condition changes of processes which may be carried out as appropriate by those skilled in the art as the scope of the invention as long as such actions meet the gist of the invention. Moreover, it is also possible to carry out a combination of any of the respective embodiments and the respective variations described above.

For example, in the above-described first and second embodiments, multiple crucibles may be provided corresponding to the number of cooling rolls and sequentially supplied with a molten alloy from different pouring units, one production apparatus may be provided with three or more cooling rolls, or one crucible may be provided with multiple openings to perform pouring on the multiple cooling rolls sequentially. In addition, in the above-described third and fourth embodiments, one cooling roll may be provided with three or more cooling zones. Alternatively, the scope of the invention also includes an apparatus and a method in which a cooling roll including multiple cooling zones is combined with a cooling roll including a single cooling zone, and the molten alloy is sequentially supplied to these three or more cooling zones. By increasing the cooling zones, it is possible to increase the upper limit sheet thickness of a producible foil strip. While the conventional cooling roll with the single cooling zone is capable of achieving the upper limit sheet thickness of 25 μm, it is possible to form thick amorphous alloy foil strips, almost continuously, specifically, as thick as 50 μm by using two cooling zones, 75 μm by using three cooling zones, and 100 μm by using four cooling zones. The molten metal supplying unit can also employ a tundish provided with multiple nozzles that face the outer circumferential surfaces of the cool zones.

INDUSTRIAL APPLICABILITY

According to the invention, it is possible to provide an apparatus for producing an amorphous alloy foil strip and a method for producing an amorphous alloy foil strip, which are capable of producing an amorphous alloy foil strip having a large sheet thickness in an industrial scale.

The invention claimed is:

1. A method for producing an amorphous alloy foil strip, comprising:

a first process of supplying a molten alloy to a first cooling zone while rotating a cooling roll, the first cooling zone forming a part of an outer circumferential portion of the cooling roll and extending along a circumferential direction of the cooling roll; and a second process of supplying the molten alloy to a second cooling zone while rotating the cooling roll, the second cooling zone forming other part of the outer circumferential portion of the cooling roll, the second cooling zone being separated from the first cooling zone in an axial direction of the cooling roll with a heat-insulating zone interposed between the first cooling zone and the second cooling zone such that the outer circumferential surfaces of the first cooling zone, the second cooling zone and the heat-insulating zone form a continuous surface of the cooling roll, wherein the heat-insulating zone is made of a material different than the material forming the first and second cooling zones, the first process and the second process being alternately executed.

2. The method for producing an amorphous alloy foil strip according to claim 1, wherein a sheet thickness of the amorphous alloy foil strip is not less than 30 μm.

3. The method for producing an amorphous alloy foil strip according to claim 1, wherein a composition of the molten alloy is set at a composition to satisfy content percentage of iron in a range from 70 to 81 at %, content percentage of silicon in a range from 3 to 17 at %, content percentage of boron in a range from 9 to 23 at %, and a glass transition temperature equal to or above 500° C.

4. The method for producing an amorphous alloy foil strip according to claim 3, wherein the molten alloy contains tin in a range from 0.01 to 1.0 mass %.

5. The method for producing an amorphous alloy foil strip according to claim 1, wherein a composition of the molten alloy is set at a composition to satisfy content percentage of iron in a range from 70 to 81 at %, content percentage of silicon in a range from 1 to 17 at %, content percentage of boron in a range from 7 to 23 at %, a contained amount of carbon equal to or below 2 at %, and a glass transition temperature equal to or above 500° C.

6. The method for producing an amorphous alloy foil strip according to claim 5, wherein the molten alloy contains tin in a range from 0.01 to 1.0 mass %.

7. The method for producing an amorphous alloy foil strip according to claim 1, wherein a number density of pin holes on the amorphous alloy foil strip is equal to or below 25 holes/$m^2$.

8. The method for producing an amorphous alloy foil strip according to claim 1, wherein a width of the heat-insulating zone is set equal to or above one-third of a width of the amorphous alloy foil strip in the axial direction of the cooling roll.

* * * * *

UNITED STATES PATENT AND TRADEMARK OFFICE

CERTIFICATE OF CORRECTION

PATENT NO. : 8,602,086 B2
APPLICATION NO. : 13/651530
DATED : December 10, 2013
INVENTOR(S) : Takashi Sato It is certified that error appears in the above-identified patent and that said Letters Patent is hereby corrected as shown below:

In the Specification, column 9, line 26, please replace "contain in (Sn)" with - contain tin (Sn) -

Signed and Sealed this
Fifteenth Day of April, 2014

Michelle K. Lee

Michelle K. Lee
*Deputy Director of the United States Patent and Trademark Office*